US005589307A

United States Patent [19]

Takeuchi

[11] Patent Number: 5,589,307

[45] Date of Patent: Dec. 31, 1996

[54] PRINTING PLATE AND PROCESS FOR PREPARING THE SAME

[75] Inventor: Satoshi Takeuchi, Tokyo-to, Japan

[73] Assignee: Dai Nippon Printing Co., Ltd., Japan

[21] Appl. No.: 452,060

[22] Filed: May 26, 1995

[30] Foreign Application Priority Data

| | | | |
|---|---|---|---|
| May 26, 1994 | [JP] | Japan | 6-136345 |
| Aug. 11, 1994 | [JP] | Japan | 6-209389 |
| Oct. 6, 1994 | [JP] | Japan | 6-268369 |

[51] Int. Cl.[6] ..... G03G 13/26

[52] U.S. Cl. ..... 430/49; 430/130

[58] Field of Search ..... 430/49, 126, 130

[56] References Cited

U.S. PATENT DOCUMENTS

| | | | |
|---|---|---|---|
| 3,245,784 | 4/1966 | Stricklin | 430/45 |
| 3,802,879 | 4/1974 | Ovshinsky et al. | 430/49 |
| 5,326,664 | 7/1994 | Takagami et al. | 430/49 |

FOREIGN PATENT DOCUMENTS

| | | |
|---|---|---|
| 1296342 | 7/1961 | France . |
| 1512079 | 2/1967 | France . |

*Primary Examiner*—John Goodrow
*Attorney, Agent, or Firm*—Parkhurst, Wendel & Burr, L.L.P.

[57] ABSTRACT

The present invention provides a process for preparing a printing plate, comprising the steps of: providing an N-type photoconductor layer having an optical memory property on the surface of a substrate having an electrical conductivity at least in its surface to form an N-type photoconductor substrate; subjecting the N-type photoconductor layer to a desired pattern-wise exposure by batch exposure and/or photo-drawing exposure to render exposed areas electrically conductive; immersing the N-type photoconductor substrate in an electrodeposition bath to electrodeposit an ionic organic polymer contained in the electrodeposition bath to form an electrodeposit layer; and washing and drying the electrodeposited substrate to prepare a printing plate.

Further, the present invention provides a process for preparing a printing plate, comprising the steps of: subjecting an N-type photoconductor layer provided on an N-type photoconductor substrate to a desired pattern exposure by batch exposure and/or photo-drawing exposure to render exposed areas electrically conductive; electrodepositing an ink-receptive component on the exposed areas; and transferring the ink-receptive component onto a substrate for a printing plate to prepare a printing plate having an ink-receptive area.

Furthermore, the present invention provides a process for preparing a printing plate, comprising the steps of: exposing the whole surface or a necessary region of an N-type photoconductor layer provided on an N-type photoconductor substrate, thereby rendering exposed areas electrically conductivc; heating the exposed areas by hot pattern drawing to erase the conductivity of the heated areas; and electrodepositing an electrodeposition material on the remaining conductive areas to form an electrodeposit layer.

18 Claims, 7 Drawing Sheets

PRINTING PLATE AND PROCESS FOR PREPARING THE SAME

BACKGROUND OF THE INVENTION

The present invention relates to a process for preparing a printing plate and a printing plate produced by said process. More particularly, the present invention relates to a process for preparing a printing plate using an N-type photoconductor layer having an optical memory property and a printing plate produced using the printing plate preparation process.

Many processes for preparing a printing plate have hitherto been proposed in the art. Among them, a process commonly used in the art comprises coating a photosensitive resin on an aluminum plate or a zinc plate, bringing the coated plate into close contact with a photographic original plate having a desired pattern, and conducting exposure and development. In recent years, a plate product of an aluminum plate bearing thereon a previously coated photosensitive resin has become commercially available as a PS (presensitized plate), and the exposure in a desired pattern of the PS plate followed by development to prepare a printing plate has spread in the art.

On the other hand, in order to prepare a printing plate in a simpler manner, an electrophotographic plate preparation process, which can simply prepare an ink-receptive toner image on the printing plate, has been developed wherein the surface of a photoconductor or an organic photoconductor substrate is subjected to corona discharge treatment in a dark place and then exposure and toner development (dry powder development, wet liquid development, or the like) to form a toner image on the surface of the photoconductor substrate.

In an electrophotographic plate preparation process utilizing the properties of an oxide photoconductor, particularly zinc oxide (ZnO), photoconductor substrate prepared by coating the surface of a conductive substrate with a coating prepared by dispersing a fine powder of ZnO in a polymer binder and then drying the resultant coating is subjected to a series of the above steps of corona discharge, exposure, and toner development to prepare a printing plate. This process is advantageous in that all the plate preparation operations can be carried out in a dry state. Since ZnO is inherently hydrophilic, it has good wettability by dampening water used in offset printing, rendering the printing plate prepared by the above process suitable for offset printing.

On the other hand, in an electrophotographic plate preparation process using an organic photoconductor (OPC), the exposure and development are carried out in the same manner as in the case where ZnO is used. Since, however, OPC is fundamentally hydrophobic, OPC cannot receive dampening water used in offset printing when an OPC layer is present on the printing plate. In this case, not only a toner image area but also the OPC layer as a non-image area unfavorably receives an ink, making it impossible to selectively form an ink image area. For this reason, after the formation of a toner image on the surface of a substrate, the OPC layer of the non-image area should be dissolved away to expose the hydrophilic surface of the substrate.

The currently most popular PS plate has gained public favor in that the resolution and durability are excellent and good print quality can be attained. The PS plate, however, is disadvantageous in that it is expensive and has unsatisfactory photosensitivity (low sensitivity) in a novel exposing method, wherein optical drawing is carried out at a high speed, is not always compatible with the digital printing plate preparation process being in the course of development in recent years. Efforts have, of course, been made to increase the sensitivity of the photosensitive resin used in the PS plate to such an extent that the PS plate becomes suitable for laser digital plate preparation. The sensitivity, however, could not have been increased to that of the electrophotographic printing plate preparation process.

A printing plate prepared by an electrophotographic plate preparation process utilizing an oxide photoconductor can be prepared at low cost by using a conductive paper substrate or the like and has been used extensively in the field of simple printing by taking advantage of dry developer. In general, however, this printing plate has low resolution and cannot be applied to high-quality printing and printing in large volumes. The use of liquid developer can improve the resolution as compared with the use of dry developer. Since, however, the plate wear is substantially the same, the use in printing in large volumes is impossible.

The printing plate prepared by the above electrophotographic printing plate preparation process utilizing the organic photoconductor (OPC) has a plate wear of 100000 to 200000 sheets. In this printing plate, however, as described above, the OPC layer at the non-image area should be dissolved away with the toner image being used as an etching resist to expose the hydrophilic surface of the substrate. This operation deteriorates the high resolution attained by the wet development, and the resultant printing plate generally has such a resolution as will be applicable to printing for newspaper (100 to 133 lines/in.) but could not have been put to practical use for high-quality printing (not less than 175 to 300 lines/in.).

DISCLOSURE OF THE INVENTION

When an N-type photoconductor layer formed on an N-type photoconductor substrate using a substrate having a conductive surface is exposed in a desired pattern by batch exposure and/or photo-drawing exposure, electrical conductivity is developed and persistent memory (optical memory) occurs. An ink-receptive component is electrochemically deposited (electrodeposited) on the exposed area to prepare an electrodeposited substrate. The electrodeposited substrate, as such, is used as a printing plate. Alternatively, the ink-receptive component of the electrodeposited substrate is transferred onto a substrate for a printing plate to prepare a printing plate having an ink-receptive area. The above process can simply prepare a printing plate which can provide high-quality prints with high plate wear. Further, since photo-drawing can be used in the process, the process can be simplified, resulting in lowered production cost.

The following three types of printing plate preparation processes can be provided by taking advantage of the optical memory property.

First aspect

Under the above circumstances, the present invention has been made, and an object of the present invention is to provide a printing plate, which can provide high-quality prints and high plate wear, and a printing plate preparation process which can prepare such a printing plate in a simple manner, enabling a reduction in and simplification of steps involved in the printing plate preparation, an improvement in reliability of the operation, a reduction in cost, and the use of photo-drawing.

In order to attain the above object, the process for preparing a printing plate according to the first invention comprises the steps of: providing an N-type photoconductor layer having an optical memory property on the surface of a substrate having an electrical conductivity at least in its surface to form an N-type photoconductor substrate; subjecting the N-type photoconductor layer to a desired pattern-wise exposure by batch exposure and/or photo-drawing exposure to render exposed areas electrically conductive; immersing the N-type photoconductor substrate in an electrodeposition bath to electrodeposit an ionic organic polymer contained in the electrodeposition bath to form an electrodeposit layer; and washing and drying the electrodeposited substrate which, as such, is to be used as a printing plate.

The printing plate of the present invention comprises: an N-type photoconductor substrate formed by providing an N-type photoconductor layer having an optical memory property on the surface of a substrate having an electrical conductivity at least in its surface; and either or both of a lipophilic area and an oil-repellent area which has been electrodeposited pattern-wise on the surface of the N-type photoconductor layer.

The N-type photoconductor layer formed on an N-type photoconductor substrate is subjected to a desired pattern-wise exposure by batch exposure and/or photo-drawing exposure to render exposed areas electrically conductive, and an ionic organic polymer contained in an electrodeposition bath is electrodeposited on the exposed areas to form an electrodeposit layer, thereby preparing a printing plate. Thus, a printing plate which can provide high-quality prints with high plate wear can be prepared in a simple manner. Further, since photo-drawing can be used in the process, the process can be simplified, resulting in lowered production cost.

Second aspect

The second aspect of the present invention is accomplished by utilizing the first aspect of the present invention. The process for preparing a printing plate according to the second invention comprises the steps of: providing an N-type photoconductor layer having an optical memory property on the surface of a substrate having an electrical conductivity at least in its surface to form an N-type photoconductor substrate; subjecting the N-type photoconductor layer to a desired pattern-wise exposure by batch exposure and/or photo-drawing exposure to render exposed areas electrically conductive; immersing the N-type photoconductor substrate in an electrodeposition bath to electrodeposit an ink-receptive component on the exposed areas; washing and drying the electrodeposited substrate; and transferring the ink-receptive component present on the N-type photoconductor layer onto a substrate for a printing plate.

Further, according to the present invention, there is also provided a printing plate comprising a substrate for a printing plate and, formed thereon by the above process, an ink-receptive area comprising an ink-receptive component.

Third aspect

The third aspect of the present invention relates to a process for preparing a printing plate by taking advantage of light and heat. In particular, the development of electrical conductivity by exposure and the erase of the electrical conductivity by heating are carried out with respect to an N-type photoconductor layer, and an electrodeposition material is electrodeposited on the remaining conductive areas to provide a printing plate for wet printing or dry printing.

BEST MODE FOR CARRYING OUT THE INVENTION

Figure 1:
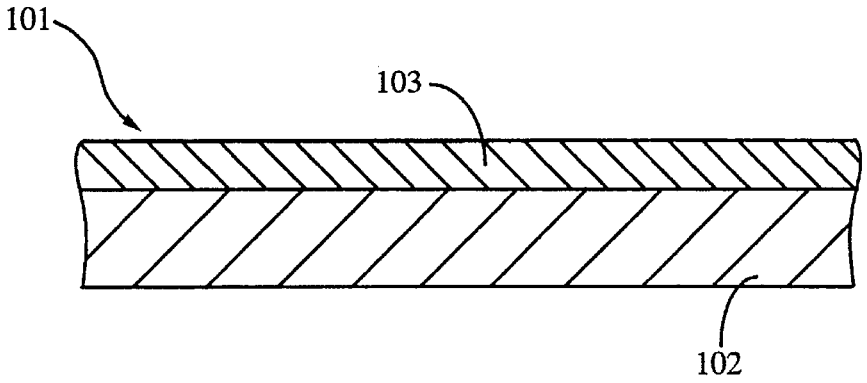
FIG. 1 shows a cross-sectional view of an embodiment of an N-type photoconductor substrate used in the present invention.

The three aspects of the present invention will now be described.

First Invention

The process for preparing a printing plate according to the present invention basically comprises utilizing the optical memory of an photoconductor, and an ionic organic polymer contained in an electrodeposition bath is electrodeposited on the optical memory area to prepare a printing plate. The electrodeposit layer formed by the electrodeposition is ink-receptive or ink-unreceptive depending upon the electrodeposition material used.

The photoconductor as the photosensitive material used in the present invention is an optical memory N-type photoconductor having such a capability that, after exposure, the exposure effect can be stored for a long period of time.

In the above N-type photoconductor, light irradiation causes the electronic conduction to be increased in the exposed area, so that the electrical conductivity of the negative charge in the exposed area becomes much higher than the unexposed area. Consequently, depending upon the construction of the semiconductor material, the unexposed area has an electrical insulating property with the exposed area becoming electrically conductive. That is, the light irradiation enables one semiconductor surface to be divided into a conductive area and an insulating area. Such a principle has already been utilized in electrophotography.

On the other hand, it is also known that a certain N-type photoconductor has an optical memory property such that the light irradiation effect (exposure effect) can be stored for a certain period of time. This optical memory property is not permanent but kept for a period of time which varies depending upon the material used. It disappears after the given period of time, and the insulating property is recovered. The time taken for the recovery can be markedly shortened by suitable heating.

As is apparent also from the fact that this type of N-type photoconductor is used in electrophotography, the photosensitivity is equal or next to that in the silver salt photography and, hence, has an advantage that the N-type photoconductor can be easily applied not only to contact exposure with a photographic original plate but also to high-speed photo-drawing scanning of argon or semiconductor laser. Further, when the N-type photoconductor is used, the toner development becomes unnecessary, offering resolution sufficient for microphotography.

The utilization of the exposure effect and the optical memory property enables the N-type photoconductor to be applied to a substrate for electrodeposition. The application of the N-type photoconductor to a substrate for electrodeposition was first made in a copy system in 1961 by E. Johnson & B. Neher (U.S. Patent No. 3010833). Thereafter, the copy system was improved and completed as electrolytic development type electrophotography (see Insatsu Kogaku IV P. 315, published on December, 1971, Kyoritsu Shuppan Co., Ltd.; Shashin Kogyo (separate volume), vol. 222; Gazo No Kagaku; Japanese Patent Publication No. 10706/1974; and the like). For the electrolytic development type electrophotography, all the applications are copying of documents, photographs and the like. Therefore, the semiconductor substrate per se becomes a product as a copying paper.

In the development process utilizing the electrolytic development, a metal is electrodeposited from a metal salt solution, or alternatively a reduction coloring dye is used by taking advantage of the reducibility of the surface of the semiconductor electrode, and monochrome and color copying are possible. In case of the monochrome copying, since the development is carried out once, the copying is completed by exposure utilizing the optical memory property followed by development. On the other hand, in the case of the multicolor copying, the development is carried out a plurality of times (usually four times) in such a manner that, after the previous exposure effect is erased by heating to an original state, next exposure for a different color is carried out (3M Corporation: Electrocolor, "Denshi Shashin-ho No Denkai Genzo-ho (Electrolytic Development by Electrophotography)")). No example is found wherein the electrolytic development type electrophotography has been applied to the production of a printing plate which should provide an image with a much higher precision than copying and have plate wear and photosensitivity high enough to be used for printing in large volumes.

The process for preparing a printing plate according to the present invention will now be described with reference to the accompanying drawings.

FIG. 1 is a schematic cross-sectional view of an N-type photoconductor substrate used in the present invention. In FIG. 1, an N-type photoconductor substrate 101 comprises a conductive substrate 102 and an N-type photoconductor layer 103 formed on the conductive substrate 102.

The conductive substrate 102 may comprise a metal plate, which as such is electrically conductive, such as a plate of Al, Zn, Cu, Fe, Ni, Cr, stainless steel, an alloy, or the like. Alternatively, it may comprise an electrical insulating substrate, such as glass, a plastic plate, a film, or paper, and a conductive deposit coating of indium tin oxide (ITO), tin dioxide ($SnO_2$), a metal, or the like provided thereon or a metallic film laminated thereon. Among the above materials, Al, Zn, stainless steel, film materials, and the like are particularly preferred. That the interface of the conductive substrate 102 and the N-type photoconductor layer 103 is electrically conductive suffices for the conductive substrate 102. Therefore, the conductive substrate 102 may be also formed of carbon or a carbon-containing conductive material.

The N-type photoconductor layer 103 is formed of an optical memory N-type semiconductor. Examples of the optical memory N-type photoconductor include zinc cadmium sulfate, zinc cadmium selenide, zinc oxide, titanium oxide, and organic semiconductors. Among them, zinc oxide, titanium oxide, and the like are useful from the viewpoint of electrical properties, optical memory properties, easiness of production, profitability, and the like.

In the present invention, the N-type photoconductor may be properly selected from the above materials. In this connection, it should be noted that, in particular, the semiconductor should satisfy such a property requirement that the electrical resistance of the optical memory area is low enough to enable the deposition of an electrodeposition material with the electrical resistance of the area, having no optical memory, being high enough to inhibit the deposition of an electrodeposition material.

More specifically, an N-type photoconductor may be preferably used which has a bright resistance of not more than $10^8$ Ωcm, the difference between a dark resistance and a bright resistance being not less than $10^2$ Ωcm.

When zinc oxide for electrophotography is used as the optical memory N-type photoconductor, the zinc oxide for electrophotography is brought to a paste using as a binder an electrical insulating resin and the paste is homogeneously coated and dried on the conductive substrate 102 to form a coating having a thickness of several μm to 30 μm, thereby providing an N-type photoconductor substrate 101. Electrical insulating resins include alkyd resin, styrene/butadiene copolymer resin, and acrylic resin. In general, styrene/butadiene copolymer resin and acrylic resin are easy to handle. A sensitizer may be added in order to improve the spectral sensitivty of the N-type photoconductor layer 103 of zinc oxide and regulate the sensitizing wavelength. Sensitizers usable herein include rose bengal, bromophenol blue, and parmanent blue. The addition of the sensitizer enables the wavelength of light used in exposure to be suitably selected in a wide range of from ultraviolet light region to visible light/near infrared region. Therefore, the N-type photoconductor substrate 101 used in the present invention has a feature that it is suitable also for output wavelengths of general-purpose lasers such as argon laser and semiconductor laser.

Figure 2A:
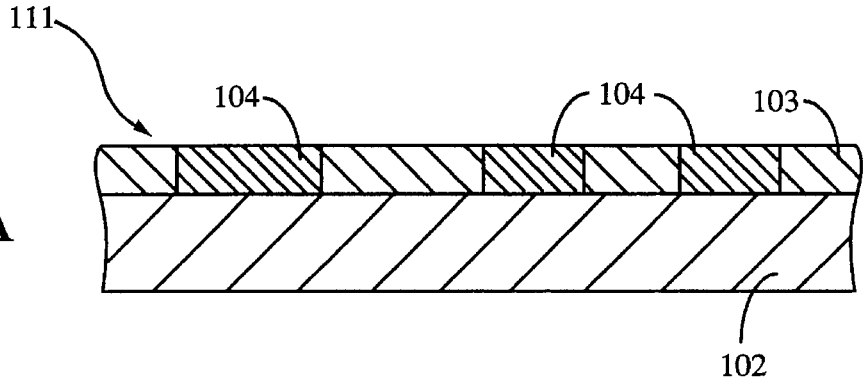
FIGS. 2A and 2B, FIGS. 4A to 4D, FIG. 5, FIGS. 6A to 6C, FIGS. 7A to 7C, and FIGS. 8A to 8E are cross-sectional views illustrating the printing plate preparation processes according to the present invention.

The process for preparing a printing plate according to the present invention will now be described with reference to FIG. 2. At the outset, the exposure of the N-type photoconductor layer 103 of the N-type photoconductor substrate 101 is carried out using a previously prepared optical drawing device or a photographic original plate (FIG. 2).

Figure 2B:
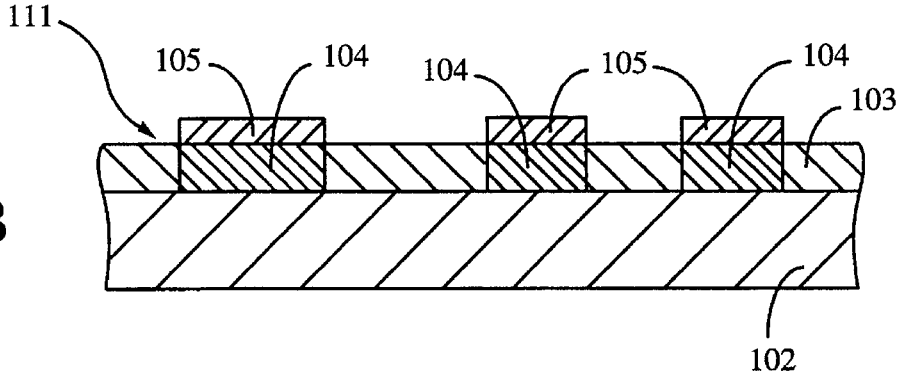

This exposure causes an exposed area 104 alone to develop memory type conductivity for a long period of time and serves as an electrodeposition area with the unexposed area of the N-type photoconductor layer 103 being kept in an insulating state. Therefore, an ionic organic polymer component contained in an electrodeposition bath described below can be electrodeposited in the electrodeposition bath on the exposed area (electrodeposition area) alone, enabling an electrodeposit layer 105 to be partially formed on the N-type photoconductor substrate 101 (FIG. 2B). In the above step of electrodeposition, the unexposed area of the N-type photoconductor layer 103 is merely in a contaminated state without electrodeposition and, hence, can be cleaned by washing with water after the electrodeposition. After the washing with water, the electrodeposited plate is dried to provide the printing plate of the present invention.

The printing plate 111 of the present invention thus prepared may be heated or photo-cured in order to enhance the abrasion resistance of the electrodeposit layer 105 or to increase the adhesion to the substrate for a printing plate.

Figure 3:
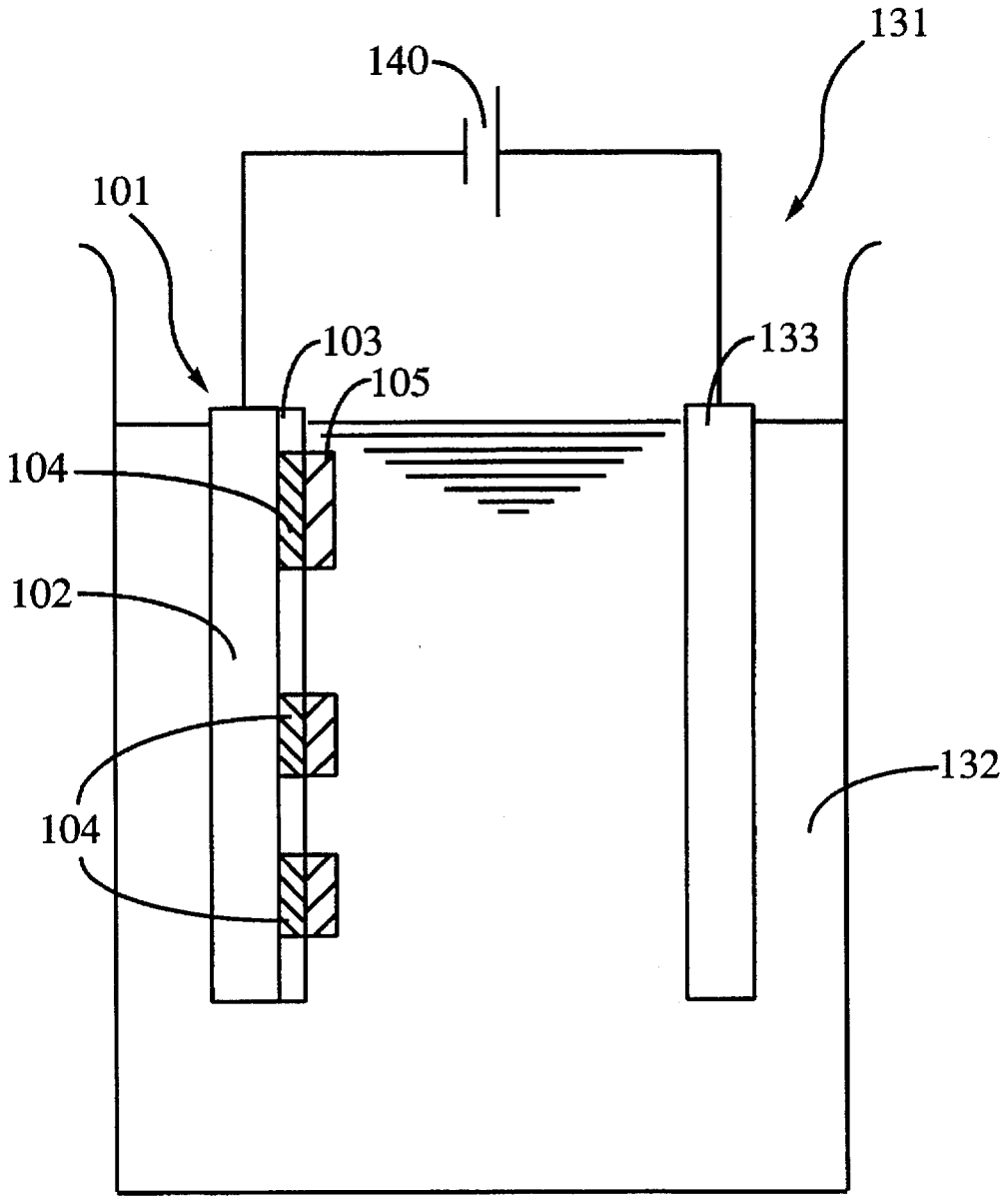
FIG. 3 is a cross-sectional view showing an embodiment of a plating tank used in the present invention.

In the present invention, the electrodeposition may be carried out using any conventional electrodeposition device, and the principle thereof is known in the art. FIG. 3 shows a schematic principal diagram of an electrodeposition tank. In FIG. 3, the electrodeposition tank 131 contains an electrodeposition solution 132. The N-type photoconductor substrate 101, which has been subjected to a desired patternwise exposure, is used as a cathode, and an insoluble conductive material, not causing electrolytic elution, for example, Ti, Pt, or carbon electrode, is used as a counter electrode 133, i.e., a positive electrode. Each electrode is connected to an external direct voltage source 140. When a direct current is allowed to flow under necessary voltage, an ionic organic polymer component contained in the electrodeposition solution 132 is electrodeposited on the exposed area 104 of the N-type photoconductor substrate 101 to form an electrodeposit layer 105. Thereafter, the electrodeposited substrate is pulled up, washed with water, and dried to provide a printing plate 111 as shown in FIG. 2B. Since the N-type photoconductor layer 103 is a photoreceptor, all the above procedures should be carried out in a dark place or under safelight.

The electrodeposition material used in the formation of the electrodeposit layer 105 according to the present invention will now be described. The electrodeposit layer 105 is generally formed of an organic material (polymer material). It is formed by a method well known as "electrodeposition (electrocoating)." The electrodeposition is classified into cationic electrodeposition and anionic electrodeposition according to the method of electrodeposition on the surface of the main electrode. This classification is based on whether the electrodeposition material behaves as cation or anion. Ionic organic polymer materials usable in the electrodeposition include various organic polymer materials such as natural fats and oils, synthetic fats and oils, alkyd resins, polyester resins, acrylic resins, and epoxy resins.

In the anionic electrodeposition, maleinized oils and polybutadiene resin are known as the ionic organic polymer material from of old, and the resultant electrodeposit layer 105 (electrodeposited material) is cured by an oxidative polymerization. On the other hand, in the cationic electrodeposition, epoxy resin organic polymer materials are mainly used alone or after modification. In addition, the so-called "polyamide resin" organic polymer materials, such as polybutadiene resin, melamine resin, and acrylic resin, and a strong electrodeposit layer 5 is formed by heat curing, photo-curing, or the like. In order to impart curability to the electrodeposit (electrodeposit layer 105), photo-curing or heat curing can be facilitated by adding a curing agent, such as an amino acid or a blocked isocyanate, or introducing a polymer group or a polymerizable unsaturated group into the resin per se.

The electrodeposited substrate in its surface comprising an oxide photoconductor is inherently hydrophilic. However, the above resins having a capability of being electrodeposited can be strongly adhered or fixed to the photoconductor. Further, in a dry state, they are receptive to an ink, facilitating the application of dampening water at the time of printing. Furthermore, since they have a high adhesion to the surface of an photoconductor, the frequency of printing failure derived from the deformation or defoliation of an electrodeposit (that is, an image area) is significantly reduced, even when a number of cyclic printing operations are carried out, providing a printing plate having high plate wear.

On the other hand, in the preparation of a plate for dry printing, a water-repellent, oil-repellent ionic organic polymer material is used as the electrodeposition materials. The materials having such properties include silicone resin and fluororesin, and an example of the practical use of such materials is such that these materials are electrodeposited on the surface of the structure to impart a water-repellent, oil-repellent property to the surface of the structure. Further, there is composite plating where these resins are dispersed in a metal plating bath and co-electrodeposited simultaneously with metal electrodeposition. For example, composite plating comprising a combination of a nickel plating solution with a fluororesin may be mentioned. Therefore, the printing plate of the present invention is applicable to dry lithography.

In this case, the printing plate may be prepared quite the same manner as shown in FIG. 2.

The printing system in the dry lithography will now be briefly described. Basically, the printing plate preparation process is the same as the process for preparing a plate for wet lithography, and these processes are different from each other in electrodeposition material alone. Specifically, the N-type photoconductor substrate is subjected to pattern-wise exposure, the semiconductor substrate 101 after exposure is immersed in an electrodeposition solution 132, containing an oil-repellent electrodeposition material, held in an electrodeposition tank 131 shown in FIG. 3, a counter electrode 133 is disposed, and a direct voltage is applied for electrodeposition. In this case, the thickness of the resultant electrodeposit coating is, for example, about 2 to 20 μm, and the electrodeposition voltage is, for example, about 40 to 100 V. After the completion of the electrodeposition, the semiconductor substrate 101 is pulled up, washed with water, and dried to prepare a printing plate 111.

In the dry printing process, since the electrodeposit layer 105 is oil-repellent (ink-repellent), the ink does not deposit thereon. On the other hand, a naked semiconductor layer 103, which is in a dry state, is lipophilic, and the ink deposits thereon. The deposited ink is transferred onto a printing medium to carry out printing. The dry printing is opposite to the wet offset printing using dampening water and is called "waterless lithography" because no dampening water is used. The ink used is preferably a special ink having lower affinity for the oil-repellent area (electrodeposit layer 105). Since no water is used, the dry lithography, as compared with the wet lithography, has various advantages, such as simplification of a printing machine, high-density and high-precision printing, and easy control. For the plate for dry lithography, the electrodeposited oil-repellent area (oil-repellent member layer) serves as a relief plate, and the ink is deposited on the concave area. Therefore, the plate for dry lithography is exactly a deep-etch plate. In this case, the amount of the ink deposited is large. Therefore, as compared with the conventional plate for wet printing (plano-convex plate type), the amount of the ink used is larger although the density is higher. However, a plate for dry lithography, which is of the same plano-convex plate type as used in the wet process, can be prepared by again subjecting the area between oil-repellent areas as a mask to exposure and electrodeposition to provide a lipophilic area (a lipophilic member layer) having a higher thickness than the oil-repellent area. Since the oil-repellent area has an electrical insulating property (this area is not electrodeposited), the re-electrodeposition on the lipophilic area can be easily carried out by subjecting the naked photoconductor to exposure on the whole area or exposure using a mask to impart selective local conductivity (a capability of being electrodeposited). Further, utilization of this method to lightly re-electrodeposit a lipophilic material having higher lipophilicity than the surface of the photoconductor enables the formation of a plate for dry printing such as deep-etch plate, plano-convex plate or complete lithographic plate wherein inking is easier.

In the conventional electrodeposition, a finely divided pigment or dye is dispersed in an anionic or cationic electrodeposition bath and co-electrodeposited together with an ionic polymer material, thereby carrying out color coating. Therefore, also in the present invention, a suitable color may be provided to the electrodeposition component in order to enhance the pattern recognition of the resultant printing plate.

In the process for preparing a printing plate according to the present invention, an N-type photoconductor is used, and when the N-type photoconductor is used as a main electrode for electrodeposition, electrons only are passed through the N-type photoconductor layer and the N-type photoconductor acts as a cathode. Therefore, the electrodeposition bath used should be cationic, and a cationic material is reduced and deposited on the exposed area (conductive area) of the N-type photoconductor layer. Therefore, it is possible to carry out electrodeposition using an electrodeposition bath of a dispersion comprising the above epoxy resin, polybutadiene resin, polyamide or other cationic resins and a colorant and electrodeposition of a metal (for example, a lipophilic metal such as Cu) using a conventional electrodeposition bath. Specific examples of the cationic electrodeposition material are described in many documents, for example, Japanese Patent Publication No. 184577/1985 and Japanese Patent Laid-Open Nos. 210901/1988 and 22379/1989, and, therefore, detailed description of the cationic electrodeposition material will be omitted.

Second invention

The process for preparing a printing plate according to the present invention basically utilizes an optical memory property of an photoconductor. An ink-receptive component is electrodeposited on the optical memory area, and the ink-receptive component is transferred onto a hydrophilic substrate for a printing plate, thereby preparing a printing plate.

The photoconductor as a photosensitive material used in the present invention utilizes the photoconductor substrate of the first invention and is an optical memory N-type photoconductor which, after pattern-wise exposure, has a function of storing the exposure effect for a long period of time. The present invention has advantages such as high plate wear and repeated utilization of the N-type photoconductor.

The process for preparing a printing plate according to the present invention will now be described with reference to the accompanying drawings.

Figure 4A:
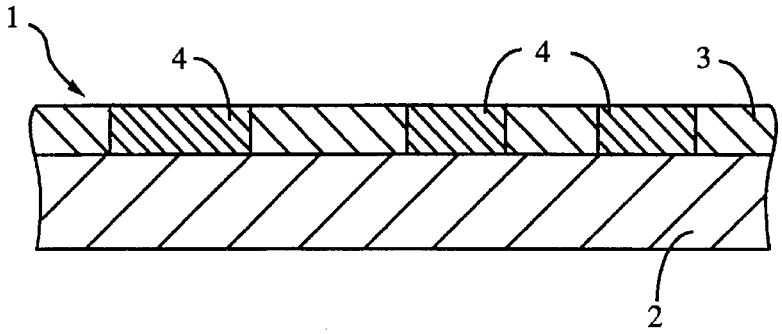
Figure 4B:
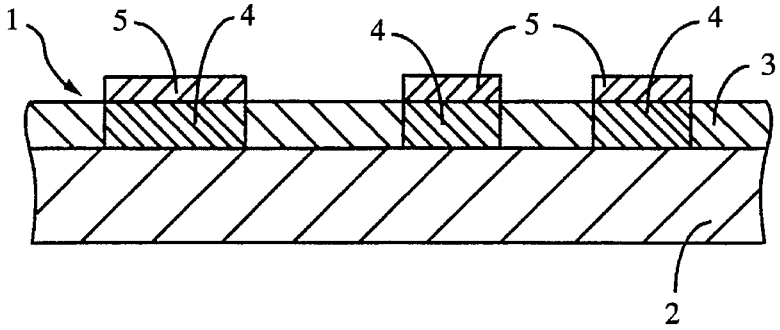

In the process for preparing a printing plate according to the present invention, at the outset, an N-type photoconductor layer 3 in an N-type photoconductor substrate 1 is exposed using a previously prepared photo-drawing device or a photographic original plate (FIG. 4A). This exposure causes conductivity having an memory property to be developed in an exposed area 4 only, and the exposed area 4 serves as an electrodeposition area, while an unexposed area in the N-type photoconductor layer 3 is kept in an electrical insulating state. Therefore, an ink-receptive component contained in an electrodeposition bath described below can be electrodeposited in the electrodeposition bath on the exposed area (electrodeposition area) alone, enabling an electrodeposit layer 5 to be partially formed on the N-type photoconductor substrate 1 (FIG. 4B). In the above step of electrodeposition, the unexposed area of the N-type photoconductor layer 3 is merely in a contaminated state without electrodeposition and, hence, can be cleaned by washing with water after the electrodeposition.

Figure 4C:
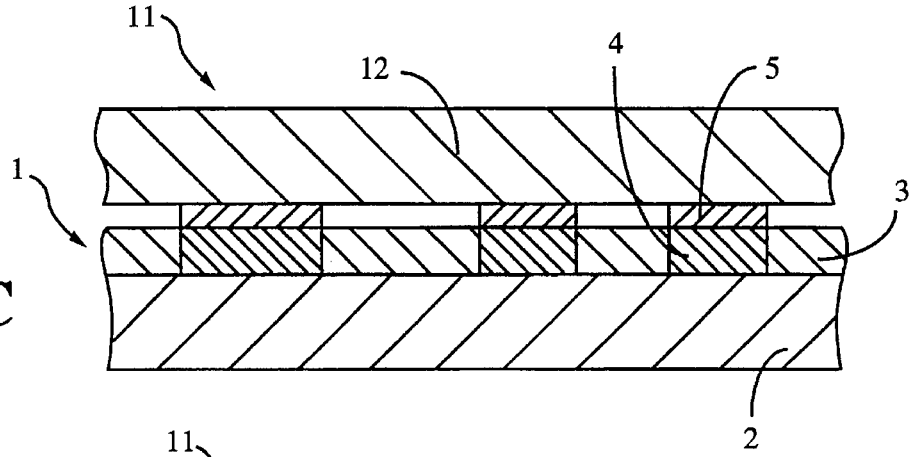
Figure 4D:
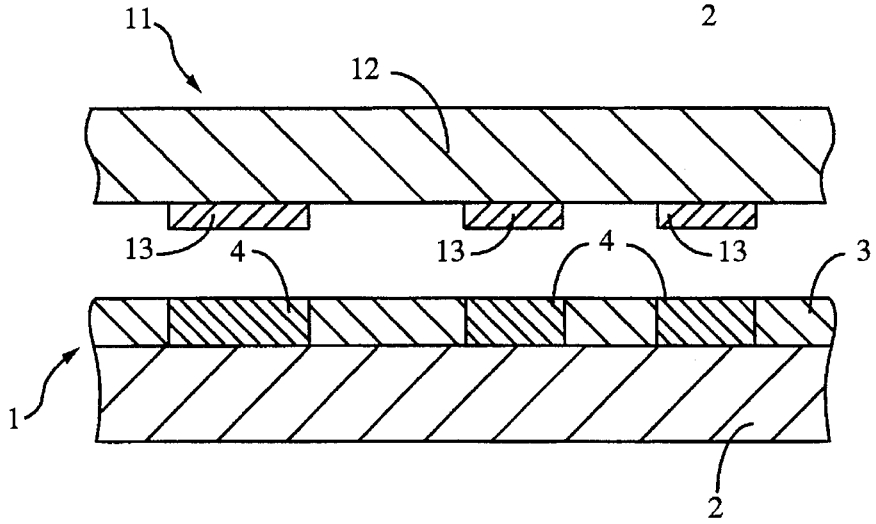

Thereafter, a substrate 12, for a printing plate, at least the surface of which is hydrophilic, is brought into press contact with the ink-receptive component layer 5 on the N-type photoconductor layer 1 and then peeled off to transfer the ink-receptive component layer 5 from the N-type photoconductor substrate 1 onto the substrate 12 for a printing plate (FIGS. 4C and 4D). By this step, an ink-receptive area 13 of a lipophilic ink-receptive component is formed on the hydrophilic substrate 12 for a printing plate, thereby preparing the printing plate 11 of the present invention. It is a matter of course that the selected ink-receptive component for electrodeposition in the present invention has an adhesive property at room temperature or an adhesive property when it is in a hot state.

The substrate 12 for a printing plate may be, for example, an aluminum substrate the surface of which has been anodized to impart high friction resistance enough to withstand printing in large volumes.

The printing plate 11 of the present invention thus prepared may be heated or photo-cured to enhance the abrasion resistance of the ink-receptive area 13 or to increase the adhesion to the substrate 12 for a printing plate, thereby improving the plate wear.

Figure 5:
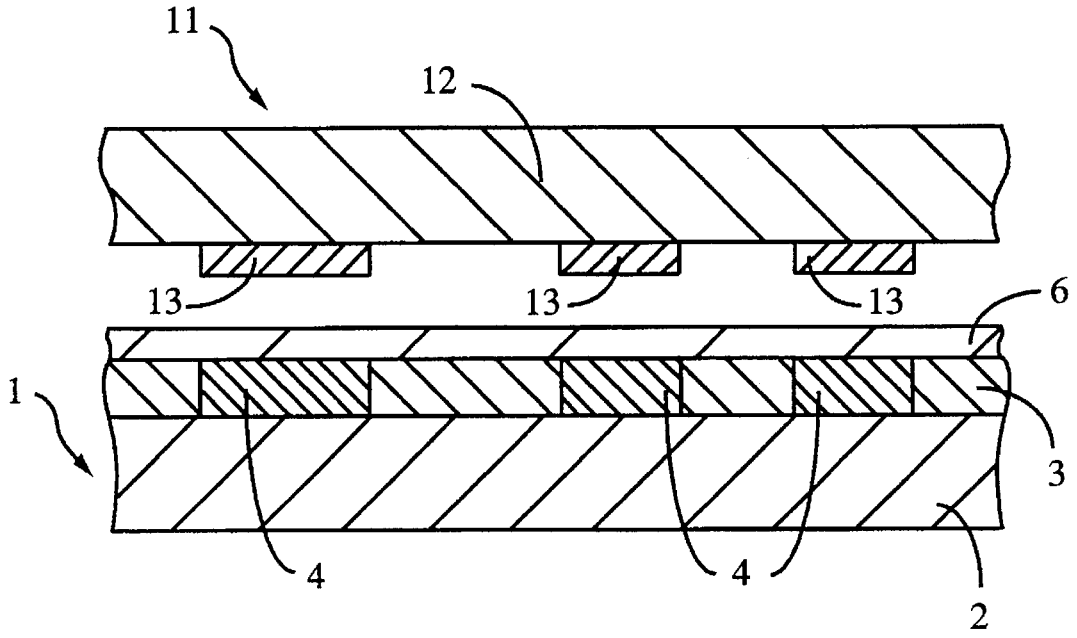

In the process for preparing a printing plate according to the present invention, if the exposed area (electrodeposition area) 4 of the N-type photoconductor layer 3 has a high adhesion to the ink-receptive component layer 5 to make it difficult to transfer the ink-receptive component layer 5 onto the substrate 12 for a printing plate, a release layer 6 as shown in FIG. 5, which does not inhibit the electrodeposition, may be previously formed on the N-type photoconductor layer 3 of the N-type photoconductor substrate 1. The formation of the release layer 6 facilitates the release of the ink-receptive component layer 5 from the interface of the release layer 6, enabling the ink-receptive component layer 5 to be stably transferred onto the substrate 12 for a printing plate. The release layer 6 may be formed of a surfactant or silicone release agent. In particular, although silicone generally has an electrical insulating property, it has a release effect even in a very thin coating form and does not inhibit the conductivity for electrodeposition in practical use.

Figure 6A:
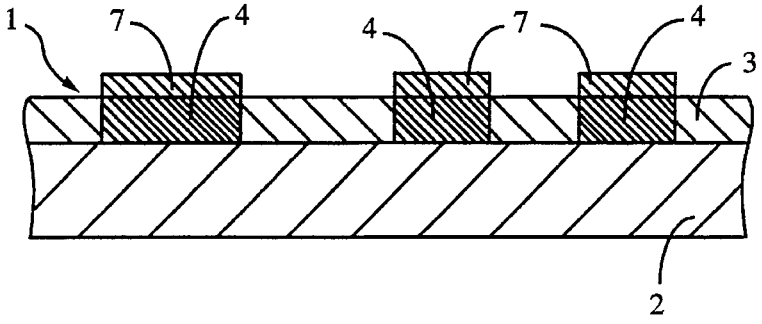
Figure 6B:
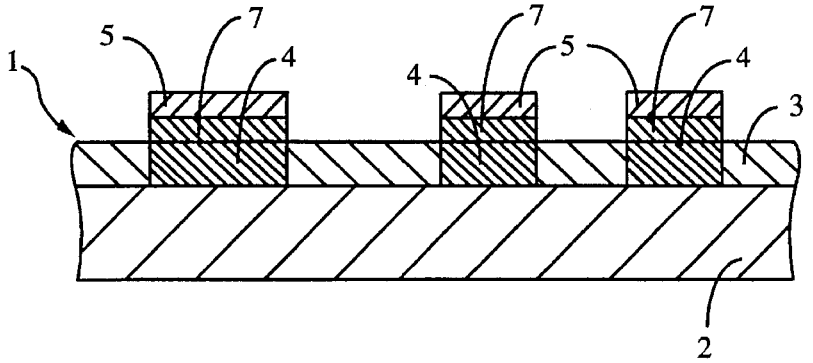
Figure 6C:
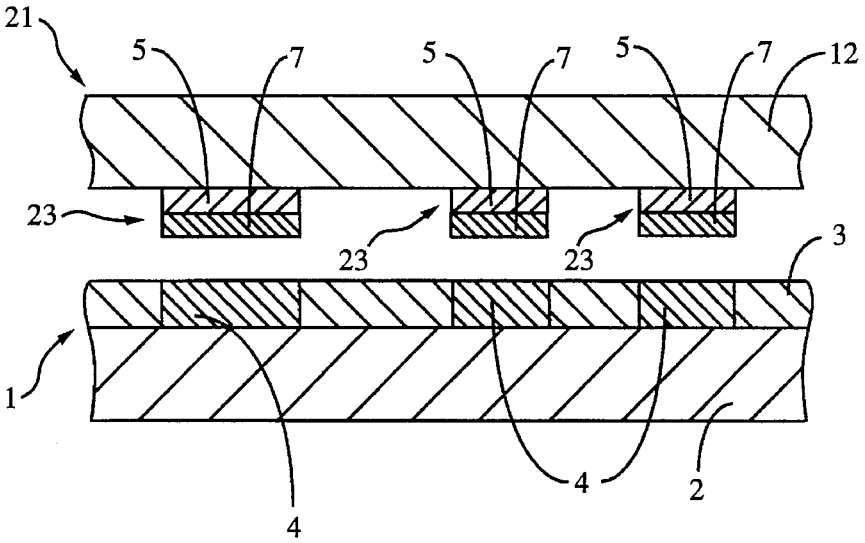

Further, in the process for preparing a printing plate according to the present invention, without the above special release treatment by forming the release layer 6 on the N-type photoconductor layer 3, it is possible to use a technique where, after the completion of exposure shown in FIG. 4A, the exposed area (electrodeposition area) 4 is subjected to primary electrodeposition of a releasable material to previously form a thin electrodeposit layer 7 (FIG. 6A) and the the thin electrodeposit layer 7 is then subjected to secondary electrodeposition of an ink-receptive component to form an ink-receptive component layer 5 (FIG. 6B). When the ink-receptive component layer 5 is formed on the N-type photoconductor layer 3 through the thin electrodeposit layer 7, the thin electrodeposit layer 7 too is transferred at the time of transfer of the ink-receptive component layer 5 onto the substrate 12 for a printing plate, thereby forming an ink-receptive area 23. Thus, a printing plate 21 is provided. Examples of the releasable material for forming the thin electrodeposit layer 7 include electrodeposition materials, for example, metals, such as Ni, Cu, Ag, and Sn, and alloys. The printing plate 21, as such, may be used for printing. In particular, since the above releasable materials are inherently lipophilic and highly ink-receptive, the printing resistance can be provided to some extent. In the case of printing in large volumes, defoliation of some of the thin electrodeposit layer 7 present in the ink receptive area 23 causes uneven deposition of ink, often resulting in deteriorated quality of prints. For this reason, it is preferred to previously remove the thin electrodeposit layer 7 present in the ink receptive area 23 also from the viewpoint of enhancing the reliability of printing.

An oxide photoconductor, such as ZnO, is inherently chemically oxidative. Light irradiation renders the oxide semiconductor reductive. For this reason, it is known that reductive deposition (electroless plating) of a metal from a metal salt contained in a solution having a low reduction potential, such as a heavy metal salt solution, can be carried out with successful results. Therefore, it is possible to carry out selective electroless plating of a metal, such as Ni, Cu, Ag, or Sn, on light-exposed area of the oxide semiconductor, and it is also possible to form, instead of the thin deposit layer 7 by the primary electrodeposition, a thin deposit layer 7 on the exposed area 4 of the N-type photoconductor layer 3 by electroless plating. The other constituent features are the same as those of the first invention.

As is apparent from the foregoing description, in the N-type photoconductor substrate 1 after transfer of the electrodeposited ink-receptive component layer 5 onto the substrate 12 for a printing plate, the exposed area 4 remains conductive, enabling the N-type photoconductor substrate 1 to be repeatedly used. Therefore, a plurality of identical printing plates can be prepared by repetition of electrodeposition and transfer using an identical N-type photoconductor substrate, contributing to an increase in efficiency and a reduction in production cost. Further, if the production of a plurality of identical printing plates is unnecessary, it is possible to use a method wherein the N-type photoconductor substrate 1 after transfer of the ink-receptive component layer 5 onto the substrate 12 for a printing plate is allowed to stand or heat-treated to erase the conductivity of the exposed area 4 and, thereafter, different pattern-wise exposure is carried out to form a new exposed area 4 which is then used for the preparation of a different printing plate. That is, a single N-type photoconductor substrate may be used a plurality of times for the preparation of various printing plates, enabling a marked reduction in production cost.

The electrodeposition device used in the present invention may be one as shown in FIG. 3. An electrodeposition agent is electrodeposited according to the first invention to form an ink-receptive component layer 105. Thereafter, the N-type photoconductor substrate 101 may be pulled up from the electrodeposition 132 and dried, and, as described above, the ink-receptive component layer 105 can be press-transferred onto the substrate 112 for a printing plate at room temperature or while heating. In this connection, it should be noted that, in the case of heat transfer, the optical memory is erased. Since the N-type photoconductor layer 103 is a photoreceptor, all the above steps should be carried out in a dark room or under safelight.

Third Invention

In the process for preparing a printing plate according to the present invention, basically, the optical memory property (conversion to conductive state) of an photoconductor and rapid erasability (conversion to electrical insulating state) of the optical memory by heat are utilized. Specifically, the conductivity of optical memory is developed by exposure, hot pattern drawing is carried out to erase some of the optical memory, and an electrodeposition material is electrodeposited on the area remaining conductive after the hot pattern drawing to form an electrodeposit layer, thereby preparing a printing plate. The electrodeposit layer is ink-receptive, ink-repellent, or dampening water-receptive depending upon the electrodeposition material constituting the electrodeposit layer.

The photoconductor as a photosensitive material used in the present invention is an N-type photoconductor having an optical memory property such that the conductivity is developed by exposure and the exposure effect is stored for a long period of time. The present invention uses the photoconductor substrate of the first invention, that is, is a modified process of the present invention.

As described above, it is known that a certain N-type photoconductor has an optical memory property such that the light irradiation effect (exposure effect) can be stored for a certain period of time. This optical memory property is not permanent but kept for a period of time which varies depending upon the material used. It disappears after the given period of time, and the insulating property is recovered. The time taken for the recovery can be markedly shortened by suitable heating. The present invention is based on effective use of the erasability of the optical memory by heat.

Accordingly, an object of the third invention is to provide a process for simply producing a printing plate which can provide a print having a high quality and a high plate wear.

The process for producing a printing plate according to the third invention comprises the steps of: providing an N-type photoconductor layer having an optical memory property on the surface of a substrate having an electrical conductivity at least in its surface to form an N-type photoconductor substrate; exposing the whole surface or a necessary region of the N-type photoconductor layer to render exposed areas electrically conductive; heating the exposed areas by hot pattern drawing to erase the conductivity of the heated areas; immersing the N-type photoconductor substrate in an electrodeposition bath to electrodeposit an electrodeposition material on the remaining conductive areas alone to form an electrodeposit layer; and washing and drying the electrodeposited substrate to prepare a printing plate.

Another process for preparing a printing plate according to the present invention comprises the steps of: providing an N-type photoconductor layer having an optical memory property on the surface of a substrate having an electrical conductivity at least in its surface to form an N-type photoconductor substrate; exposing the whole surface or a necessary region of the N-type photoconductor layer to render exposed areas electrically conductive; heating the exposed areas by hot pattern drawing to erase the conductivity of the heated areas; immersing the N-type photoconductor substrate in an electrodeposition bath to electrodeposit a light-screening and/or electrical insulating first electrodeposit layer on the remaining conductive areas alone to form a first electrodeposit layer; washing the electrodeposited substrate; exposing the N-type photoconductor substrate to again render exposed areas electrically conductive; immersing the N-type photoconductor substrate in an electrodeposition bath to electrodeposit a second electrodeposition material on only areas with the first deposit layer having not been formed, thereby forming a second electrodeposit layer; and washing and drying the electrodeposited substrate to prepare a printing plate.

The N-type photoconductor layer in its entirety or necessary region of the N-type photoconductor substrate is rendered conductive by exposure, the exposed areas is heated by hot pattern drawing to erase the conductivity of the heated areas, and an electrodeposition material is electrodeposited on the remaining conductive areas to prepare a printing plate.

Any of printing plates for wet printing and dry printing may be prepared by the same process through the selection of properties (repellency or receptivity to ink and receptivity to dampening water) of the N-type photoconductor layer and the electrodeposition material.

Further, a light-screening and/or electrical insulating first electrodeposit layer is electrodeposited on the remaining conductive areas to form a first electrodeposit layer, the N-type photoconductor substrate is again exposed to again render exposed areas electrically conductive, and a second electrodeposition material is electrodeposited on only areas with the first deposit layer having not been formed (when the first electrodeposition material has an electrical insulating property, such areas correspond to the exposed areas, while when the first electrodeposition material has an electrical insulating property alone, the first electrodeposit layer serves as an insulating mask), thereby forming a second electrodeposit layer. Thus, a printing plate is prepared. A plate for dry printing can be provided by rendering any one of the first electrodeposit layer and the second electrodeposit layer ink-receptive with the other being rendered ink-repellent. On the other hand, a plate for wet printing can be provided by rendering any one of the first electrodeposit layer and the second electrodeposit layer ink-receptive with the other being rendered hydrophilic.

Therefore, any of a printing plate for wet printing and a printing plate for dry printing, which can provide a high-quality print with a high plate wear, may be prepared in the same process. Further, it is also possible to use a thermal process using a laser beam, which process can cope with digital data.

Figure 7A:
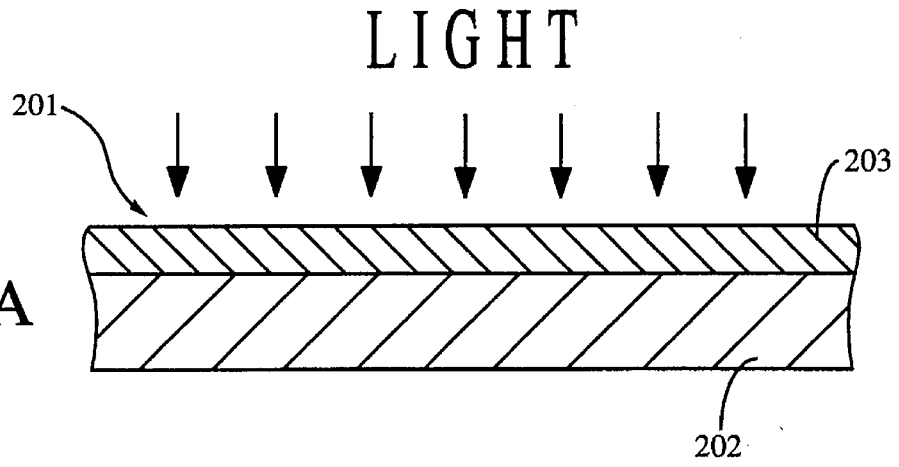

The process for preparing a printing plate according to the present invention will now be described with reference to FIG. 7. At the outset, light at sensitizing wavelength is applied homogeneously to the whole surface or necessary region of the N-type photoconductor 203 of the N-type photoconductor substrate 1 (FIG. 7A). This exposure results in the development of memory-type conductivity in the N-type photoconductor layer 203. When the sensitizing wavelength light is visible light, the N-type photoconductor substrate 201 may be exposed to general room light or the like.

Figure 7B:
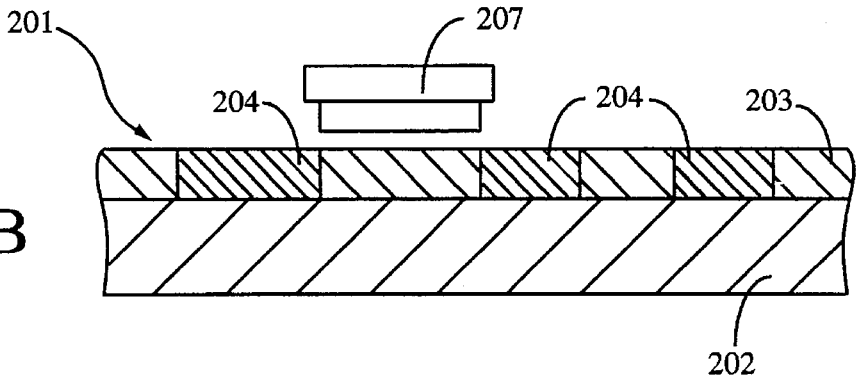

Subsequently, in a dark place, an image pattern is formed using a suitable heat source 207 on the surface of the conductive N-type photoconductor layer 3 (FIG. 7B). This erases the conductivity at the heated areas, causing the insulating property to be locally returned with the other areas (unheated areas) being left as remaining conductive areas 204.

Figure 7C:
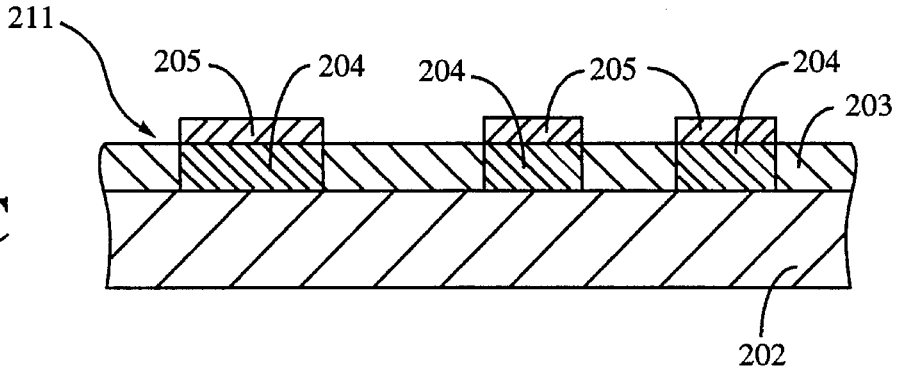

Then, the N-type photoconductor substrate 201 is subjected to electrodeposition in an electrodeposition bath, whereby the electrodeposition material can be deposited on the remaining conductive areas 205 only. Consequently, an electrodeposit layer 205 is partially formed on the N-type photoconductor substrate 201 (FIG. 7C). On the other hand, electrodeposition does not occur on the areas which has been locally returned to an electrical insulating state.

The printing plate 211 of the present invention thus prepared may be heated or photo-cured to enhance the abrasion resistance of the electrodeposit layer 5 or to increase the adhesion to the N-type photoconductor layer 203, thereby improving the plate wear.

Since the electrodeposition material is generally receptive to an ink, the electrodeposit layer 205 can be easily inked at the time of printing. On the other hand, the surface of the N-type photoconductor layer is hydrophilic and, hence, has good receptivity to dampening water. Therefore, the printing plate 211 can be effectively utilized for wet lithography.

By contrast, when a water-repellent, oil-repellent silicone resin or fluororesin is used, the electrodeposit layer 205 becomes ink-repellent, so that no ink is deposited on the layer 205 with the ink being deposited on the dried surface of the N-type photoconductor layer. Therefore, in this case, the resultant printing plate can be used for dry lithography wherein no dampening water is used.

An example of electrodeposition of a water-repellent, oil-repellent resin is to impart a water-repellent, oil-repellent property to the surface of the structure.

In ordinary electrodeposition, a finely divided pigment or dye, independently of whether the pigment or dye is inorganic or organic, may be dispersed in the ionic electrodeposition bath and co-deposited together with the ionic polymer material at the time of electrodeposition, thereby providing a colored deposit. This is true of other fillers. Therefore, in the first to third inventions, the pattern recognition of the printing plate can be improved by coloring of the electrodeposit layer 205, or fillers can be used to improve the properties of the electrodeposit layer 205. For example, an electrodeposition solution with polytetrafluoroethylene (PTFE: teflon) being dispersed therein may be used to form an electrodeposit layer 5 having increased ink repellency, thereby improving the suitability of the printing plate 211 for dry printing. Specific examples of such electrodeposition solution include a combined electrodeposition solution in the form of a dispersion of PTFE in a nickel ion solution.

In the present invention, hot pattern drawing for thermally erasing the memory-type conductivity developed in the N-type semiconductor layer 203 may be carried by various methods such as the simplest method wherein hot drawing is carried out with a suitable hot pen, a method wherein recording is carried out by means of a thermal recording head provided with a heating element, a method wherein a gas laser beam or a semiconductor laser beam is condensed to carry out scanning recording in a heat mode, and a method wherein a pattern permeable to hot rays is previously prepared, brought into close contact with the semiconductor layer, and subjected to batch exposure to infrared light. All of these thermal recording means are known in the art, and, therefore, detailed description thereof will be omitted.

In the above process for preparing a printing plate according to the present invention, an N-type photoconductor substrate 201 is subjected to homogeneous exposure and hot pattern drawing to form an ink-receptive or ink-repellent electrodeposit layer, and the hydrophilicity of the N-type photoconductor layer 203 and the ink deposition thereof in a dried state are utilized to prepare a plate for wet or dry printing.

The printing plate prepared by the above printing plate preparation process is a printing plate utilizing the difference in properties between the electrodeposit layer and the N-type photoconductor layer. According to the printing plate preparation process of the present invention, the property difference can be further made large to prepare a printing plate having further improved suitability for printing. For example, in the preparation of a printing plate for dry lithography, in order to further enhance the ink repellency of the ink-repellent electrodeposit layer, it is difficult to select a proper material. However, the formation of an electrodeposit layer having higher receptivity to an ink than the N-type photoconductor layer is relatively easy. This is because the number of kinds of oil-repellent materials is small, whereas there are many candidates for lipophilic materials (most resins being lipophilic). Therefore, among the lipophilic materials, many materials have such a property that electrodeposition property could be imparted, increasing the range of selection. An embodiment of the above printing plate preparation process will now be described with reference to FIG. 8.

Figure 8A:
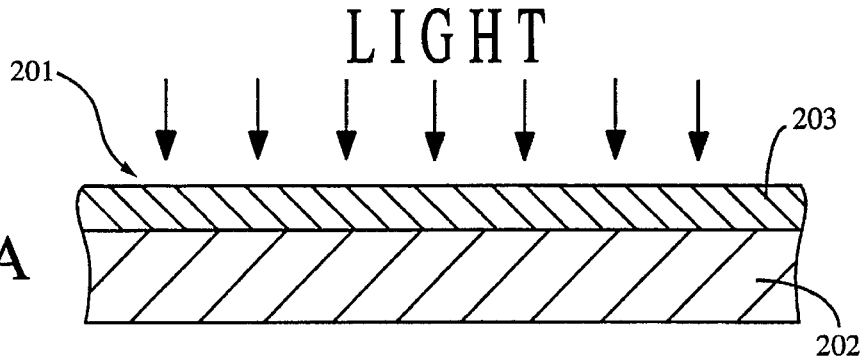
Figure 8B:
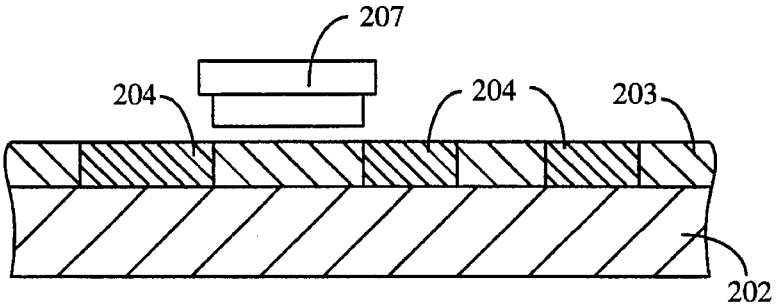
Figure 8C:
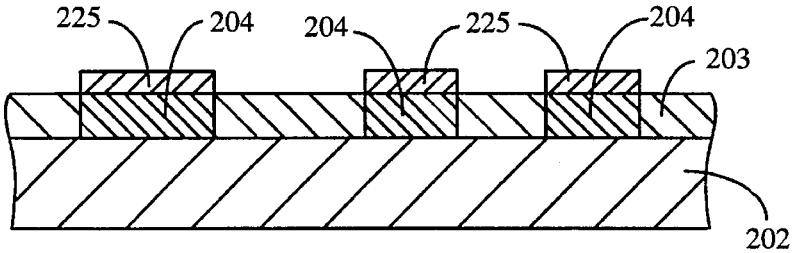

At the outset, an N-type photoconductor layer 203 of an N-type photoconductor substrate 1 is homogeneously exposed in the same manner as in the above printing plate preparation process (FIG. 8A). In a dark place, an image pattern is drawn on the conductive area of the N-type photoconductor layer 203 by means of a suitable heat source 207 (FIG. 8B). Thereafter, the N-type photoconductor substrate 201 is subjected to electrodeposition in an electrodeposition tank to electrodeposit a light-screening and/or electrical insulating first electrodeposition material, thereby forming a first electrodeposit layer 225 (FIG. 8C). Therefore, the first electrodeposit layer 225 thus formed has a light-screening and/or electrical insulating property. The N-type photoconductor substrate 1 is heated or allowed to stand for a long period of time to erase the remaining conductive area 204 of the N-type photoconductor layer 203.

Figure 8D:
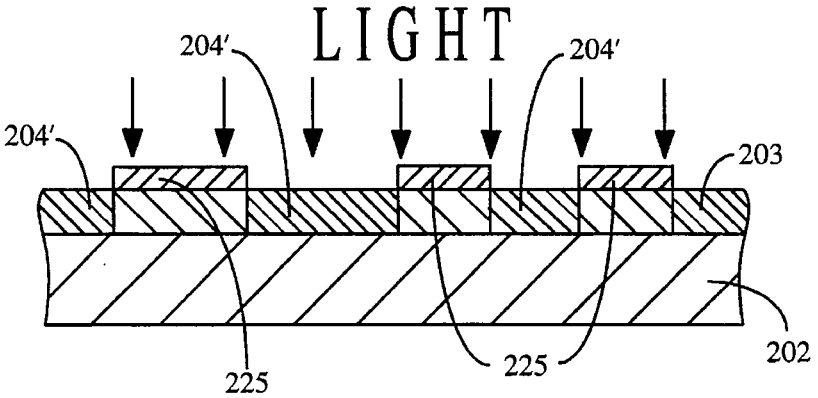
Figure 8E:
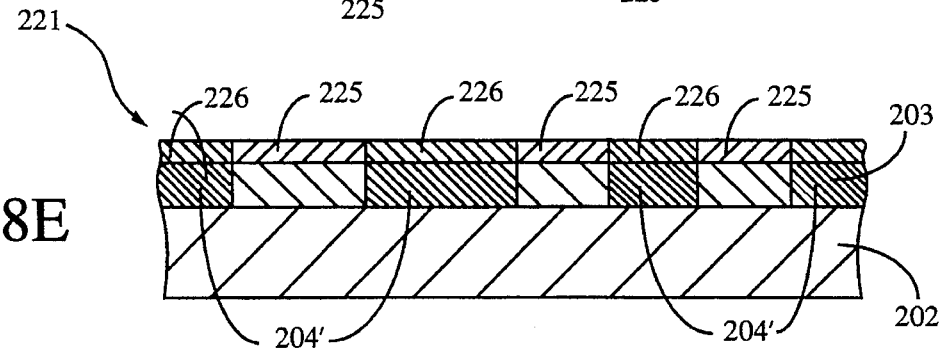

Subsequently, the whole surface of the N-type photoconductor substrate 201 is subjected to homogeneous exposure using the first electrodeposit layer 225 as a light-screening mask (FIG. 8D). When the first electrodeposit layer 225 has a light-screening property, the N-type photoconductor layer 203 in only its areas where no first electrodeposit layer 225 has been formed is exposed to again develop the conductivity (FIG. 8D showing this embodiment). On the other hand, when the first electrodeposit layer 225 has an electrical insulating property alone, the conductivity is again developed on the whole surface of the N-type photoconductor layer 203 (not shown). Thereafter, the N-type photoconductor substrate 201 is subjected to electrodeposition in an electrodeposition bath to electrodeposit a second electrodeposition material, having properties different from the first electrodeposition material on the exposed area (conductive area) only (when the first electrodeposit layer 225 has a light-screening property) to form a second electrodeposit layer 226, thereby preparing a printing plate 221 (FIG. 8E). When the first electrodeposit layer has an electrical insulating property alone without a light-screening property, the conductivity is developed also in the N-type photoconductor layer 203 underlying the first electrodeposit layer 225. In this case, however, the first electrodeposit layer 225 serves as an insulating mask at the time of electrodeposition of the second electrodeposition material, so that the second electrodeposit layer 226 is formed in only the areas where no first electrodeposit layer has been formed. Therefore, the resultant printing plate 221 is the same as in the above case (when the first electrodeposit layer 225 has a light-screening property).

As compared with the printing plate 221 utilizing the difference in properties between the electrodeposit layer 205 and the N-type photoconductor layer 203, the printing plate 221, prepared by combining the first electrodeposition material with the second electrodeposition material in such a manner that the second electrodeposit layer 226 is rendered ink-repellent when the first electrodeposit layer 225 is ink-receptive, while the second electrodeposit layer 226 is rendered ink-receptive when the first electrodeposit layer 225 is ink-repellent, has a greater difference between the ink repellency and the ink receptivity, so that the suitability of the printing plate 221 for dry printing is superior. More specifically, since the lipophilicity of the N-type photoconductor 203 is generally lower than that of the electrodeposit layer, the addition of an acrylic resin or an epoxy resin to the electrodeposit layer, for example, can improve the lipophilicity of the electrodeposit layer, which makes it possible to easily prepare a plate, for drying printing, having a large difference between the ink receptivity and the ink repellency and better suitability for dry printing. The other constituent features are the same as those of the first invention.

The present invention will now be described in more detail with reference to the following examples of the first invention.

Example A1

A paste of an N-type photoconductor having the following composition was coated on a 0.15 mm-thick aluminum substrate having a specular surface, and the resultant coating was dried to form a 10 μm-thick coating, thereby preparing an N-type photoconductor substrate.

| (Composition of N-type photoconductor paste) | |
|---|---|
| Fine-grained powder of zinc oxide | 50 g |
| Styrene-butadiene copolymer | 10 g |
| Rose bengal | Minor amount |
| Toluene | 50 ml |

The N-type photoconductor substrate was allowed to stand in a dark room overnight to erase the optical memory effect, and previously prepared 175 line/in. halftone plate and negative photographic film containing a letter were brought into close contact with the surface of the N-type photoconductor substrate, and the resultant laminate was exposed to tungsten light. Thereafter, the substrate was immersed in the following electrodeposition bath to electrodeposit an ink-receptive component. The electrodeposition conditions were as follows.

| (Compositions of electrodeposition bath) | |
|---|---|
| Acrylic resin | 50 parts |
| Ethyl cellosolve | 25 parts |
| Isopropyl alcohol | 3 parts |
| Acetic acid | 1.5 parts |
| Phthalocyanine blue pigment | 3 parts |
| Water | 800 parts |

At the outset, acrylic resin, ethyl ethyl cellosolve, and the pigment were mixed together. The resultant mixture was milled in a ball mill until the pigment particles became fine. The remaining components were added thereto, and the mixture was stirred to prepare the above composition.

(Electrodeposition conditions)

Main electrode: cathode

Counter electrode: titanium

Distance between electrodes: 5 to 10 cm

Bath temp.: 25° C.

Applied voltage: 60 to 80 V

Thickness of electrodeposit coating: about 3 μm

Drying after electrodeposition: washing with water followed by air blow to blow off free water Heat treatment: 100° to 130° C. for 10 to 20 min The photoconductor printing plate was applied to the following wet offset printing.

In the offset printing, a conventional simple offset sheet-fed press (a printing machine manufactured by AB Dick Co., Ltd. for the present example), as such, was used without any modification. According to a conventional printing method, a conventional offset ink and dampening water were used, the above photoconductor printing plate was set in a printing roll and lightly wiped with an etchant to regulate the receptivity to dampening water, a necessary amount of dampening water was applied, inking was carried out, and paper was fed to initiate printing.

The prints thus obtained were good, and the quality thereof was comparable to that of prints obtained by a PS plate. The plate wear was not less than several tens of thousands of sheets. Thus, it was confirmed that the printing plate of the present invention had a quality equal to the PS plate.

Example A2

In Example A1, a 0.2 mm-thick polyester film with a deposit coating of aluminum formed on one side thereof was used as a film substrate instead of the aluminum substrate of Example A1. The method of forming an photoconductor layer, the composition of an electrodeposition bath, conditions for preparation of a printing plate by electrodeposition were the same as those of Example 1, except that a flat bed type argon laser drawing device was used for pattern-wise exposure to attempt a digital direct plate preparation of a 175 line halftone plate. The heat treatment, after a series of steps of electrodeposition, washing with water and drying, was not carried out, and, after washing with water and air blowing, the plate was allowed to stand in a room or alternatively dried by air of several tens of °C. to complete the preparation of a printing plate.

In a printing operation, the quality of the prints was similar to that of Example A1. The plate wear, however, was lower than that in the case of the aluminum plate in Example A1 and 10000 to 20000 sheets. This was due to damage to the film substrate by printing pressure during printing and other factors, and it was found that the printing plate could be used without any problem in printing for the production of a relatively small number of prints.

Example A3

In Example A1 and Example A2, a commercially available ultraviolet curing cationic electrodeposition material was used as an ionic ink-receptive organic polymeric material. The ultraviolet curing electrodeposition material used was cationic Elecoat UC 500 (trade name), manufactured by Shimidzu Co., Ltd., which was composed mainly of a polymer having a photo-curable acryloyl group. Electrodeposition was carried out according to the following procedure.

(Electrodeposition conditions)

Distance between electrodes: 5 to 10 cm

Counter electrode: carbon

Bath temp.: 25° C.

Electrodeposition voltage: 60 to 80 V

Electrodeposition time: about 20 sec

Drying and curing conditions

Redrying: about 75° C.

Curing (Hg lamp used): not less than 800 mj/cm$^2$

In the present example, photo-curing after the electrodeposition provided printing plates having quality and printing performance equivalent to those in Example A1 and Example A2. It was confirmed that these printing plates could be effectively used in wet offset printing.

Example A4

In Example A4, a dry offset (a waterless) printing plate was prepared, and printing was actually carried out according to the following procedure.

The photoconductor substrates used were the same as those in Example A1 and Example A2. Pattern-wise exposure was carried out in the same manner as in Example A1 and Example A2. A dispersion prepared by mixing and dispersing an ionic fluoropolymer and an atomized (average particle diameter: 0.2 μm) teflon (tetrafluoroethane (PTFE)) in each other was used as the electrodeposition material.

the electrodeposition material containing an ionic fluoropolymer exists as a commercially available product called "Elecoat Nicelon" ((trade name) manufactured by Shimidzu Co., Ltd.). The structure of this material is mainly such that a side chain having a perfluoro group is attached as a pendant group to an acrylic skeleton. This material, as such, is water-repellent and oil-repellent. In addition, it has a feature that it can satisfactorily disperse PTFE having better water repellency and oil repellency and homogeneously co-precipitate PTFE in an electrodeposit coating, resulting in further improved water repellency and oil repellency. In the present example, an electrocoating prepared by incorporating PTFE in an amount of 25% (weight ratio on a solid basis) into Elecoat Nicelon was used as the water-repellent, oil-repellent electrodeposition material.

Electrodeposition was carried out under the same conditions as that in Example A3 to form an about 4 μm-thick electrodeposit coating. Heat treatment after a series of steps of electrodeposition-washing with water-drying increases the concentration of PTFE particles around the surface of the electrodeposit coating, enhancing the oil-repellent effect. For this reason, heat treatment was carried out at 180° to 200° C. for about 10 min in the case of the aluminum substrate and at 120° C. for 10 min in the case of the polyester film substrate to prepare printing plates.

Dry offset printing was carried out according to the following procedure.

The printing machine used in the previous examples was used also in this example. A printing plate was mounted on a plate cylinder, and a blanket cylinder and an impression cylinder were adjusted. Thereafter, a conventional special printing ink for a silicone plate (a silicone plate being commonly used for dry printing) was placed in an ink duct and fed to the printing plate through an ink roller without use of dampening water. A major difference between the special ink for dry printing used herein and an ink for wet printing is that the special ink for dry printing has very high tackiness (i.e., is sensuously hard) and, unlike the ink for wet printing, does not have sticky high enough to cause thread-forming.

In inking by the special ink for dry printing, the ink was not deposited on the oil-repellent electrodeposit but deposited only on the surface of the exposed photoconductor layer. The deposited ink was transferred onto the blanket according to the printing mechanism and again transferred onto paper being passed through the blanket cylinder to carry out printing. The printing machine could be operated with good results. This system is more exactly a dry deep-etch plate offset printing method wherein an ink is fed into a dent or concave between protruded oil-repellent material layers. For this reason, the amount of the ink used was large, and high-density prints could be obtained as in the case of dry printing using the conventional silicone plate. The plate wear was not less than 100000 sheets for the aluminum plate and about 20000 sheets for the polyester plate.

Example A5

The following experiment was carried out using the dry printing plate prepared in Example A4.

Specifically, the surface of the printing plate was sufficiently exposed to ultraviolet light (intense tungsten light may also be usable), and electrodeposition was carried out using the electrocoating of Example A3 to form an ink-receptive layer between the oil-repellent layers. In this connection, it should be noted that the already formed oil-repellent layer has an electrical insulating property and, hence, serves as an electro deposition mask to prevent an electrodeposit from being deposited thereon. The ink-receptive layer was electrodeposited between the oil-repellent layers to a thickness larger by 2 to 3 μm than the thickness of the oil-repellent layer. Thus, the so-called "plano-convex plate" was obtained wherein the ink-receptive layer was in a protruded state.

It was confirmed that printing using the plano-convex plate type dry printing plate had advantages including that the provision of the ink-receptive layer facilitated the deposition of the ink enabling easily inking, the amount of the ink used is smaller than that in the case of the deep-etch plate and the transfer onto the blanket and the paper is easier.

Example A6

A 0.2 mm-thick polyester film with a deposit coating of aluminum formed on one side thereof was used as a film substrate. A paste of an N-type photoconductor having the following composition was coated thereon, and the resultant coating was dried to form a 10 μm-thick photoconductor layer.

| | |
|---|---|
| Zinc oxide (SAZEX 2000, manufactured by Sakai Chemical Co., Ltd.) | 4 g |
| Titanium oxide (rutile type) | 16 g |
| Polyvinyl butyral (BM-S, manufactured by Sekisui Chemical Co., Ltd.) | 5 g |
| Toluene | 50 ml |

The N-type photoconductor substrate was allowed to stand in a dark room overnight to erase the optical memory effect, and previously prepared 175 line/in. halftone plate and negative photographic film containing a letter were brought into close contact with the surface of the N-type photoconductor substrate, and the resultant laminate was exposed to light from a high pressure mercury lamp. Thereafter, the substrate was then immersed in the electrodeposition bath of Example A3 to electrodeposit an ink-receptive component. The electrodeposition was carried out in the same manner as in Example A3.

In the present example, photo-curing after the electrodeposition provided a printing plate having a quality and a plate wear equivalent to those in Example A3. It was confirmed that the printing plate could be effectively used in wet offset printing.

As described above in detail, a comparison of printing plates using an photoconductor having an optical memory property according to the present invention and a process for producing the same with the conventional PS plates, printing plates by electrophotography, and silver salt printing plates, and the like reveals that, in general, the low cost and easy processing are comparable to those in the printing plates prepared by electrophotography, the quality (the quality of the printed image, plate wear, and the like) is comparable to that of the PS plates and the sensitivity is comparable to that attained in the electrophotography and the silver salt process (the optical drawing method or the like being usable), that is, that the printing plate of the present invention is a versatile printing plate.

From the viewpoint of printing method, the process for preparing a printing method and the printing plate according to the present invention have, unlike the conventional plate preparation processes and printing plates, versatility, enabling the use in various printing processes, Such that printing can be carried out in the conventional wet printing using dampening water by the conventional method, a printing plate for dry printing not using dampening water can be easily prepared in the same manner by using an oil-repellent electrodeposition material and offset printing and direct printing (particularly in dry process) are possible.

Therefore, the use of the printing plate and the plate preparation process according to the present invention enables printing which copes with a wider range of prints and offers various effects including that the amount of ink consumed can be reduced, high-density printing is possible and high added values can be provided such as the provision of cost-effective and high-quality prints in various fields.

The second aspect of the present invention will now be described in more detail with reference to the following examples.

Example B1

A paste of an N-type photoconductor having the following composition was coated on a 0.15 mm-thick aluminum substrate having a specular surface, and the resultant coating was dried to form a 10 μm-thick coating. Further, a dilute solution of a silicone release agent was lightly coated at such a coverage as will not inhibit the conductivity to prepare an N-type photoconductor substrate.

| (Composition of N-type photoconductor paste) | |
|---|---|
| Zinc oxide | 50 g |
| Styrene-butadiene copolymer | 10 g |
| Rose bengal | Minor amount |
| Toluene | 50 ml |

Subsequently, in a dark room, previously prepared 175 line/in. halftone plate and negative photographic film containing a letter were brought into close contact with the surface of the N-type photoconductor substrate, and the resultant laminate was exposed to tungsten light. Thereafter, the substrate was immersed in the following electrodeposition bath to electrodeposit an ink-receptive component. The electrodeposition conditions were as follows.

| (Compositions of electrodeposition bath) | |
|---|---|
| Acrylic resin | 50 parts |
| Ethyl cellosolve | 25 parts |
| Isopropyl alcohol | 3 parts |
| Acetic acid | 1.5 parts |
| Phthalocyanine blue pigment | 3 parts |

-continued

| (Compositions of electrodeposition bath) | |
|---|---|
| Water | 800 parts |

At the outset, acrylic resin, ethyl ethyl cellosolve, and the pigment were mixed together. The resultant mixture was milled in a ball mill until the pigment particles became fine (not more than 0.2 μm). The remaining components were added thereto, and the mixture was stirred to prepare the above composition.

(Electrodeposition conditions)

Main electrode: cathode

Counter electrode: platinum plate

Applied voltage: increased from an initial voltage of 20 V gradually to 80 V according to an increase in an electrodeposit coating.

Thickness of electrodeposit coating: about 3 μm

Drying after electrodeposition: washing with water followed by air blow to blow off free water Then, a 0.2 mm-thick aluminum substrate, of which the surface has been rendered hydrophilic by anodization, was prepared as a substrate for a printing plate. The aluminum substrate was put on top of the N-type photoconductor substrate so that the anodized surface of the aluminum substrate faced the electrodeposited surface of the N-type photoconductor substrate. The laminate was pressed, and both the substrates were separated from each other to transfer the electrodeposited ink-receptive component of the N-type photoconductor substrate onto the aluminum substrate. All the above steps of exposure, electrodeposition, and transfer were carried out in a dark room.

Thereafter, the aluminum substrate was heat-treated at 150° C. for 10 to 20 min to improve the adhesion of the transferred ink-receptive portion and to impart the plate wear, thereby preparing the printing plate of the present invention. Printing was carried out by a sheet-fed offset press using the printing plate. The pretreatment of the printing plate at the time of printing was carried out in the same manner as used in the conventional PS plate. As a result, the plate wear of the printing plate according to the present invention was about 100000 sheets, and the quality of the prints was good.

The above N-type photoconductor substrate could be repeatedly used for electrodeposition and transfer operations to prepare 10 or more identical printing plates.

Example B2

An N-type photoconductor substrate was prepared in the same manner as in Example B1, except that no silicone release agent was coated. The substrate was then exposed in the same manner as in Example B1.

Thereafter, the N-type photoconductor substrate was immersed in the following electrodeposition bath to carry out primary electrodeposition of Cu on the exposed area. The primary electrodeposition was carried out under the following conditions.

| (Composition of bath for primary electrodeposition of Cu) | |
|---|---|
| Copper pyrophosphate | 94 g/liter |
| Potassium pyrophosphate | 340 g/liter |

-continued

| (Composition of bath for primary electrodeposition of Cu) | |
|---|---|
| 28% aqueous ammonia | 3 ml/liter |
| (Electrodeposition conditions) | |
| pH of bath for primary electrodeposition of Cu: | 8.8 |
| Temp. of bath for primary electrodeposition of Cu: | 55° C. |
| Electrodeposition rate (5 A/dm$^2$): | 1.0 μm/min |

Secondary electrodeposition of the ink-receptive component on Cu was carried out in the same manner as in Example B1, and the ink-receptive component was transferred onto the aluminum substrate in the same manner as in Example B1 to prepare the printing plate of the present invention. The ink-receptive portion of the printing plate had a copper color because Cu had been transferred together with the ink-receptive component. The printing plate was heat-treated in the same manner as in Example B1, and the surface of the printing plate was washed with a dilute ferric chloride ($FeCl_3$) solution to remove Cu present on the surface of the ink-receptive portion. Printing was carried out using this printing plate in the same manner as in Example B1. As a result, the plate wear was about 100000, and the quality of the prints was good. In the printing plate with Cu remaining unremoved, the plate wear was about several thousands to ten thousand sheets, and Cu was partially peeled off to cause unevenness of printing.

Example B3

An N-type photoconductor substrate was prepared in the same manner as in Example B1, except that a flexible substrate of a 0.2 mm-thick polyester film with an aluminum foil bonded thereto was used instead of the aluminum substrate of Example B1.

Then, the N-type photoconductor substrate was wound around a drum type argon laser drawing device (an exposing device) and exposed using a 200 line/in. halftone plate, and electrodeposition and transfer were carried out in the same manner as in Example B1 to prepare a printing plate. The printing plate was heat-treated in the same manner as in Example B1.

Printing was carried out in the same manner as in Example B1, except that the above heat-treated printing plate was used. As a result, the plate wear of the printing plate was about 100000, and the quality of the prints was good.

The N-type photoconductor substrate after transfer was heat-treated at 80° to 110° C. for 10 to 20 min to erase the optical memory (electrical conductivity at the exposed area), cooled at room temperature, and again subjected to optical drawing exposure using other image data, electrodeposition, and transfer, thereby preparing a printing plate. The above N-type photoconductor substrate could be repeatedly used for electrodeposition and transfer operations to prepare 10 or more identical printing plates.

Example B4

An N-type photoconductor substrate was prepared in the same manner as in Example B3, and optical drawing exposure was carried out. Then, the N-type photoconductor was immersed in an electrodeposition bath to electrodeposit the ink-receptive component.

The electrodeposition bath used was prepared as follows. At the outset, N,N-dimetylaminoethyl acrylate: 115 parts, 2-hydroxyethyl methacrylate: 150 parts, n-butyl acrylate: 400 parts, methyl methacrylate: 150 parts, n-butyl methacrylate: 185 parts, and azobisisobutyronitrile: 50 parts were mixed together, and a reaction was allowed to proceed to prepare as a stock solution (solid content: about 60%) a solution of an adhesive electrodeposition material dissolved in ethyl cellosolve. Then, 12000 parts of deionized water was added to a mixed solution of stock solution: 1000 parts, blocked isocyanate: 120 parts, and dibutyltin dilaurate: 19 parts to prepare a cationic adhesive electrodeposition bath having a solid content of 5%. The electrodeposition was carried out under the following conditions.

(Electrodeposition conditions)

Main electrode: cathode

Counter electrode: platinum plate

Applied voltage: 80 V (for 60 sec)

Drying after electrodeposition: washing with water followed by air blow to blow off free water The surface of the ink-receptive component electrodeposited on the N-type photoconductor substrate was highly adhesive, and when the N-type photoconductor substrate was pressed against the anodized aluminum substrate as the substrate for a printing plate, the ink-receptive component was easily peeled and transferred onto the side of the anodized aluminum substrate. The printing plate thus prepared was heat-treated at 130° C. for 10 min, and printing was carried out using this printing plate in the same manner as in Example B1. As a result, the plate wear was about 100000, and the quality of the prints was good.

Example B5

A paste of an N-type photoconductor having the following composition was coated on a flexible substrate of a 0.2 mm-thick polyester film with an aluminum foil adhered thereto, and the resultant coating was dried to form a 10 μm-thick coating. Further, a dilute solution of a silicone release agent was lightly coated in such an amount as will not sacrifice the electrical conductivity, thereby preparing an N-type photoconductor substrate.

| (Composition of N-type photoconductor paste) | |
|---|---|
| Titanium oxide (rutile type) | 20 g |
| Polyvinyl butyral (BM-S, manufactured by Sekisui Chemical Co., Ltd.) | 5 g |
| Toluene | 40 ml |

Thereafter, in a dark room, previously prepared 175 line/in. halftone plate and negative photographic film containing a letter were brought into close contact with the surface of the N-type photoconductor substrate, and the resultant laminate was exposed to high pressure mercury lamp. Thereafter, the substrate was immersed in the electrodeposition bath of Example B4 to electrodeposit an ink-receptive component. The electrodeposition and the preparation of the printing plate were carried out in the same manner as in Example B4. Printing was carried out using this printing plate in the same manner as in Example B1. As a result, the plate wear was about 100000, and the quality of the prints was good.

Separately, a printing plate was prepared in the same manner as described just above, except that a paper substrate was used as the substrate for a printing plate instead of the anodized aluminum substrate and the heat treatment at 130° C. for 10 min was omitted. The paper substrate used was such that an agent, for imparting a hydrophilic property, comprising a titanium white pigment as a main component and a hydrophilic polymer material (such as PVA) as a binder was coated on the surface of water-resistant paper (thickness 0.3 mm) to render the whole surface of the paper receptive to dampening water. Printing was carried out using this printing plate in the same manner as in Example 1, and the quality of the prints was good. Due to the omission of the heat treatment, the use of the paper substrate, and other factors, the plate wear was about several thousand to ten thousand sheets.

Further, the above N-type photoconductor substrate, as such, could be repeatedly used for electrodeposition and transfer operations to prepare 10 or more identical printing plates.

As is apparent form the above detailed description, as compared with the conventional process for preparing a PS plate and the process for preparing a plate by electrophotography through toner development, the present invention enables a printing plate to be prepared by a very simple process by taking advantage of an N-type photoconductor substrate and the persistence of the exposure effect or memory property thereof. Further, the transfer of an ink-receptive component onto the surface of a hydrophilic substrate as a substrate for a printing plate enables the transferred ink-receptive component to be used as an ink-receptive component of the printing plate. Since the ink-receptive portion can be formed homogeneously with high resolution and high fineness, the resultant printing plate has excellent plate wear and can provide high-quality prints. Further, by virtue of the optical memory property of the N-type photoconductor layer in the N-type photoconductor substrate, an identical N-type photoconductor substrate can be repeatedly used for the production of a plurality of identical printing plates. Furthermore, since the optical memory property of the N-type photoconductor layer can be easily erased, the identical N-type photoconductor substrate can be repeatedly used for exposure and electrodeposition and transfer, which enables a plurality of different types of printing plates to be prepared from an identical N-type photoconductor substrate. Furthermore, digital images and numerical design data subjected to image processing can be utilized in an optical drawing device, enabling optical drawing to become possible without use of any photographic original plate. This further simplifies the process, resulting in a marked reduction in production cost.

Example C1

A deposit coating of aluminum was formed on one side of a 0.2 mm-thick polyester film, and the aluminum-deposited film was used as a substrate. A paste of an N-type photoconductor having the following composition was coated thereon, and the resultant coating was dried to form a 20 μm-thick dried coating, thereby preparing an N-type photoconductor substrate. Since the preparation of the N-type photoconductor substrate was carried out in a bright room, the whole surface of the N-type photoconductor layer became electrically conductive.

| (Composition of N-type photoconductor paste) | |
|---|---|
| Zinc oxide | 50 g |
| Styrene-butadiene copolymer | 10 g |
| Rose bengal | Minor amount |
| Toluene | 50 ml |

In a dark room, previously prepared 175 line/in. halftone plate and positive-working original plate containing a letter (prepared by etching of an aluminum deposit coating) were brought into close contact with the surface of the N-type photoconductor substrate, and the resultant laminate was exposed to light from a 1 kW infrared lamp, and the N-type photoconductor layer at its exposed areas was thermally returned to an electrical insulating state. Thereafter, the N-type photoconductor substrate was immersed in the following electrodeposition bath to electrodeposit an ink-receptive component on the remaining conductive portion, thereby preparing a printing plate for wet lithography. The electrodeposition was carried out under the following conditions.

| (Composition of electrodeposition bath) | |
|---|---|
| Acrylic resin | 50 parts |
| Ethyl cellosolve | 25 parts |
| Isopropyl alcohol | 3 parts |
| Acetic acid | 1.5 parts |
| Water | 800 parts |
| Phthalocyanine blue (pigment) | 3 parts |

At the outset, acrylic resin, ethyl cellosolve, and the pigment were mixed together. The resultant mixture was milled in a ball mill until the pigment particles became fine (not more than 0.2 μm). The remaining components were added thereto, and the mixture was stirred to prepare the above composition.

(Electrodeposition conditions)

Main electrode (N-type optical semiconductor substrate): cathode

Counter electrode: titanium plate

Distance between electrodes: 5 to 10 cm

Applied voltage: 60 V

Bath temp.: 25° C.

Thickness of electrodeposit coating: about 3 μm

Drying after electrodeposition: washing with water followed by air blow to blow off free water The resultant printing plate was used to carry out printing by means of a simple offset sheet-fed press (manufactured by AB Dick Co., Ltd.). The ink, dampening water, and etchant used were commercially available products. The printing plate was mounted on a plate cylinder, and the surface thereof was lightly treated with the etchant. The amount of necessary dampening water was regulated, and inking and feed of paper were carried out for printing. As a result, the prints obtained using the printing plate according to the present invention had a good quality which was comparable to the quality of prints obtained using a PS plate.

Example C2

An N-type photoconductor substrate was prepared in a bright place in the same manner as in Example C1.

Thereafter, two types of digital thermal recording were carried out on the N-type semiconductor substrate. One of them was thermal recording using a thermal head for conventional thermal recording, and the other was scanning thermal recording using 500 mmW large output semiconductor laser (870 nm). In the case of scanning of semiconductor laser, in order to enhance the thermal conversion efficiency, a 1 μm-thick black coating layer (containing carbon) was provided on one side of a 175 μm-thick transparent polyester film, the transparent polyester film and the N-type photoconductor substrate were brought into close contact with each other so that the black coating layer faced N-type photoconductor layer. In this connection, it should be noted that although direct scanning of semiconductor laser onto the N-type photoconductor layer causes reflection, scanning of the semiconductor laser through the black coating layer can improve the thermal conversion efficiency. The recording was carried out in a negative mode with a recording density of 400 dpi. Output images were letters, including kanji (Chinese characters), and symbols of 8 points, 10 points, and 12 points.

By the digital thermal recording, the periphery of the letters and symbols was thermally scanned in a digital manner to cause the erase of conductivity and the return of insulating property, and printing areas alone remained conductive.

Thereafter, electrodeposition was carried out under the same conditions as those of Example C1 to prepare a printing plate for wet lithography.

Offset printing was carried out using the resultant printing plate in the same manner as in Example C1. As a result, it was confirmed that the quality of prints obtained using the printing plate of the present invention was good and corresponded to 400 dpi.

Example C3

An N-type photoconductor substrate was prepared in a bright place in the same manner as in Example C1.

Then, two types of digital thermal recording was carried out on the N-type photoconductor substrate in the same manner as in Example C2, except that the recording mode was positive.

Thereafter, the N-type photoconductor substrate was immersed in an electrodeposition bath to electrodeposit an ink-repellent component on the remaining conductive portion, thereby forming an electrodeposit layer. The composition of the electrodeposition bath used was the same as that in Example C1, except that the following oil-repellent resin component was used instead of the electrodeposition resin component in Example C1. Further, the electrodeposition conditions were the same as those used in Example C1. A dispersion prepared by mixing and dispersing a cationic fluoropolymer and an atomized (average particle diameter: 0.2 μm) teflon (tetrafluoroethane (PTFE)) in each other was used as the oil-repellent resin (PTFE content of dispersion: 25% in terms of weight ratio on a solid basis). The ionic fluoropolymer has a structure such that a side chain having a perfluoro group is attached to an acrylic skeleton. This material, as such, is water-repellent and oil-repellent. In addition, it has a feature that it can satisfactorily disperse PTFE having better water repellency and oil repellency and homogeneously co-precipitate PTFE in an electrodeposit coating.

After the formation of the electrodeposit layer, washing with water and drying were carried out. Heat treatment after these steps can increase the concentration of PTFE particles around the surface of the electrodeposit coating, further improving the oil-repellent effect of the electrodeposit layer. The higher the heat treatment temperature (180° to 200° C.), the better the heat treatment effect. In the present example, since the substrate was a polyester film, the heat treatment was carried out at 120° C. for 10 min to prepare a printing plate for dry lithography. The resultant printing plate was mounted on a plate cylinder of a simple offset sheet-fed press (manufactured by AB Dick Co., Ltd.), and a blanket cylinder and an impression cylinder were adjusted. Thereafter, a conventional special printing ink for a silicone plate was placed in an ink duct and fed to the printing plate through an ink roller without use of dampening water, and printing was then carried out on sheets.

In inking by the special ink for dry printing, the ink was not deposited on the oil-repellent electrodeposit but deposited only on the surface of the exposed surface of the N-type photoconductor layer. The deposited ink was transferred onto the blanket according to the printing mechanism and again transferred onto paper being passed through the blanket cylinder to carry out printing. The resultant prints obtained using the printing plate of the present invention. The plate wear was about 20000 sheets.

Example C4

An N-type photoconductor substrate was prepared in a bright place in the same manner as in Example C1.

Then, digital thermal recording was carried out on the N-type photoconductor substrate in the same manner as in Example C2, except that the recording mode was positive.

Thereafter, a first electrodeposit layer (thickness 2 μm) was formed by electrodeposition of an ink-repellent component on the remaining conductive portions in an electrodeposition bath in the same manner as in Example C3. The composition of the electrodeposition bath used was the same as that in Example C3.

The N-type photoconductor substrate was then allowed to stand in a bright place for several hours (or alternatively may be exposed to light from a 1 kW mercury lamp for 10 sec) to again expose the N-type photoconductor substrate, thereby rendering the whole surface of the N-type photoconductor layer (including a region where the first electrodeposit layer is formed) electrically conductive. Thereafter, an ink-receptive component was electrodeposited on the conductive portion using same electrodeposition bath and electrodeposition conditions as in Example C1, thereby forming a second electrodeposit layer (thickness 3 μm). In this case, it should be noted that, since the first electrodeposit layer has an electrical insulating property and serves as an insulating mask, the second electrodeposit layer is not formed on the first electrodeposit layer. Thereafter, washing with water and drying followed by heat treatment at 120° C. for 10 min were carried out to prepare a plate A for dry printing.

Separately, an N-type photoconductor substrate was prepared in a bright place in the same manner as in Example C1, and digital thermal recording (negative mode) was carried out by means of a thermal head on an N-type photoconductor substrate in the same manner as in Example C2.

Thereafter, an ink-receptive component was electrodeposited on the remaining conductive portions using the same electrodeposition bath (except that 15 parts of carbon black was used instead of 3 parts of phthalocyanine as the color component) and electrodeposition conditions as in Example C1 to form a first electrodeposit layer (thickness 3 μm). The first electrodeposit layer contains carbon black. Therefore, although the electrical insulating property thereof is unsatisfactory as compared with that of the first electrodeposit layer in the printing plate A, it has a light screening property.

Thereafter, the N-type photoconductor substrate was exposed for a short period of time (exposed to light from a 1 kW mercury lamp for 10 sec). In this exposure, the first electrodeposit layer served as a light screening mask, and the N-type photoconductor layer in its region where no first electrodeposit layer had been formed was again rendered electrically conductive. Thereafter, an ink-repellent component was electrodeposited on the conductive areas in an electrodeposition bath in the same manner as in Example C3, thereby forming a second electrodeposit layer (thickness 2 μm). The composition of the electrodeposition bath used was that of the electrodeposition bath of Example C3. Thereafter, washing with water and drying were curried out followed by heat treatment at 120° C. for 10 min, thereby preparing a plate B for dry printing.

Printing was carried out on paper using the printing plates A and B by dry printing in the same manner as in Example C3. The prints obtained using the printing plates A and B had a high density and a good quality comparable to prints obtained by the convectional dry printing process, and the amount of the ink used could be reduced as compared with that for the printing plate of Example C3. The reason for this is as follows. The printing plate of Example C3is a deep-etch plate consisting of an N-type semiconductor layer and an oil-repellent electrodeposit layer, and inking is carried out in the concave areas (N-type semiconductor layer), so that the amount of the ink used is large although high-density printing is possible. By contrast, the printing plates A and B of Example C4 are of plano-convex type (the same type as the conventional wet lithography) wherein the ink-receptive area is 1 μm higher than the oil-receptive area, so that the amount of the ink used is substantially the same as that in the case of wet lithography, enabling the amount of the ink used to be reduced as compared with the conventional dry lithography.

Further, the following facts were confirmed. Since the printing plates A and B of Example C4 are of plano-convex type, the deposition of the ink is good enough to facilitate inking. Further, as opposed to wet printing, emulsification of ink by dampening water does not occur. Therefore, high-density printing is possible even when the amount of the ink used may be smaller than that used in the wet printing. In addition, sharper printed images can be provided.

Further, the second electrodeposit layer as the ink-receptive area of the printing plate A in Example 4 and the first electrodeposit layer as the ink-receptive area of the printing plate B in Example C4 have a higher lipophilic property than the N-type semiconductor layer as the ink-receptive area of Example C3, so that inking is possible even when an ink having higher tackiness than a special ink for dry printing is used. For this reason, it is expected that in the preparation of an ink which is less susceptible to scumming or tinting of the print and failure of inking, a design having a higher degree of freedom is possible, which in turn makes it possible to prepare an ink which is easy to use.

Example C5

A paste of an N-type photoconductor having the following composition was coated on a 0.15 mm-thick aluminum substrate having a specular surface, and the resultant coating was dried to form a 20 μm-thick coating, thereby preparing an N-type photoconductor substrate.

| (Composition of N-type photoconductor paste) | |
|---|---|
| Zinc oxide (SAZEX 2000, manufactured by Sakai Chemical Co., Ltd.) | 4 g |
| Titanium oxide (rutile type) | 16 g |
| Dye having absorption in near infrared region (Kayasorb CY-10, manufactured by Nippon Kayaku Co., Ltd.) | 0.1 g |
| Polyvinyl butyral (BM-S, manufactured by Sekisui Chemical Co., Ltd.) | 5 g |
| Toulene | 50 ml |

After exposure with a high pressure mercury lamp, scanning thermal recording was carried out using a semiconductor laser (780 nm) having a large output of 500 mW. The recording mode was negative, the recording density was 2500 dpi, and output images were letters, including kanji (Chinese characters), and symbols of 2 points, 4 points, and 6 points. Thereafter, electrodeposition was carried out under the same conditions as those of Example C1 to prepare a printing plate for wet lithography. Offset printing was carried out using the resultant printing plate in the same manner as in Example C1. As a result, it was confirmed that the quality of prints obtained using the printing plate of the present invention was good and corresponded to 2500 dpi.

As is apparent from the above detailed description, according to the present invention, as compared with the conventional PS plate preparation process, the electrophotographic plate preparation process by toner development, and the plate preparation process by the silver salt photographic process, the utilization of an N-type semiconductor substrate having an optical memory property, the persistence of the exposure effect, and the formation of a pattern latent image by erase upon heating can highly simplify the process, enabling shortening and simplification of the plate preparation process and an improvement in reliability of the operation. Further, plates for wet or dry printing, which provide high-quality prints with high plate wear, can be freely prepared by an identical process through the selection of an electrodeposition material, which enables the preparation of printing plates having versatility high enough to be applicable to various printing processes. Further, as described above, since thermal plate preparation is possible, plate preparation utilizing laser or precise thermal head is applicable to the field of high-quality printing, so that the formation of a pattern by using the conventional thermal head for the output in word processors or personal computers, a hot pen, or other means can be advantageously used in the field of simple printing and printing for business purposes. Therefore, the use of the printing plate preparation process according to the present invention offers many effects such as a wider range of printing, the reduced amount of ink consumed, improved quality of the print, and markedly reduced production cost.

I claim:

1. A process for preparing a dry lithographic printing plate, comprising the steps of:

providing an N-type photoconductor layer having an optical memory property on the surface of a substrate having an electrical conductivity at least in its surface to form an N-type photoconductor substrate;

subjecting the N-type photoconductor layer to a desired pattern-wise exposure by at least one of batch exposure and photo-drawing exposure to render exposed areas electrically conductive;

immersing the N-type photoconductor substrate in an aqueous electrodeposition bath containing an ionic organic polymer having oil-repellent properties after electrodeposition to electrodeposit said ionic organic polymer contained in the electrodeposition bath to form an oil-repellent electrodeposit layer which is unreceptive to a printing ink; and washing and drying the electrodeposited substrate to obtain a dry lithographic printing plate.

2. The process for preparing a printing plate according to claim 1, wherein said electrodeposit layer is further cured by exposure to heat or light to improve the adhesion of the electrodeposit layer to the substrate, thereby increasing the plate wear.

3. The process for preparing a printing plate according to claim 1, wherein the electrodeposit layer is utilized as a light screening layer and/or electrical insulating mask, non-exposed areas are exposed to render said areas electrically conductive, a member receptive or unreceptive to a printing ink is electrodeposited on the non-exposed areas and the resultant printing plate is used in dry lithography.

4. A dry lithographic printing plate, comprising:

an N-type photoconductor substrate formed by providing an N-type photoconductor layer having an optical memory property on the surface of a substrate having an electrical conductivity at least in its surface; and a lipophilic area and an oil-repellent area formed on the surface of the N-type photoconductor layer, said oil-repellent area being electrodeposited pattern-wise.

5. A process for preparing a printing plate, comprising the steps of: providing an N-type photoconductor layer having an optical memory property on the surface of a substrate having an electrical conductivity at least in its surface to form an N-type photoconductor substrate; subjecting the N-type photoconductor layer to a desired pattern-wise exposure by batch exposure and/or photo-drawing exposure to render exposed areas electrically conductive; immersing the N-type photoconductor substrate in an electrodeposition bath to electrodeposit an ink-receptive component on the exposed areas; washing and drying the electrodeposited substrate; and transferring the ink-receptive component present on the N-type photoconductor layer onto a substrate for a printing plate.

6. The process for preparing a printing plate according to claim 5, wherein, after the ink-receptive component has been transferred onto the substrate for a printing plate, the N-type photoconductor substrate is repeatedly used without erasing the conductivity developed in the N-type photoconductor layer.

7. The process for preparing a printing plate according to claim 5, wherein, after the ink-receptive component has been transferred onto the substrate for a printing plate, the conductivity developed in the N-type photoconductor layer is erased and a desired pattern exposure is newly carried out on the N-type photoconductor layer.

8. The process for preparing a printing plate according to claim 5, wherein a release layer, which does not inhibit the electrodeposition of the ink-receptive component, is formed on the N-type photoconductor layer, the exposure and the electrodeposition of the ink-receptive component are carried out and, thereafter, the ink-receptive component alone is transferred onto the substrate for a printing plate.

9. The process for preparing a printing plate according to claim 5, wherein, after the exposure of the N-type photoconductor layer, a releasable material releasable from the N-type photoconductor layer is electrodeposited on the exposed areas, the ink-receptive component is electrodeposited and, thereafter, the ink-receptive component, together with the releasable material, is transferred onto the substrate for a printing plate.

10. The process for preparing a printing plate according to claim 9, wherein, after the transfer of the ink-receptive component onto the substrate for a printing plate, the releasable material alone is removed from the substrate for a printing plate.

11. The process for preparing a printing plate according to claim 5, wherein, after the transfer of the ink-receptive component onto the substrate for a printing plate, the substrate for a printing plate is subjected to a treatment for curing the ink-receptive component transferred onto the substrate for a printing plate or a treatment for improving the adhesion between the ink-receptive component and the substrate for a printing plate.

12. A printing plate comprising a substrate for a printing plate and an ink-receptive component formed on the substrate for a printing plate by the process for producing a printing plate according to claim 1.

13. A process for preparing a printing plate, comprising the steps of: providing an N-type photoconductor layer having an optical memory property on the surface of a substrate having an electrical conductivity at least in its surface to form an N-type photoconductor substrate; exposing the whole surface or a necessary region of the N-type photoconductor layer to render exposed areas electrically conductive; heating the exposed areas by hot pattern drawing to erase the conductivity of the heated areas; immersing the N-type photoconductor substrate in an electrodeposition bath to electrodeposit an electrodeposition material on the remaining conductive areas alone to form an electrodeposit layer; and washing and drying the electrodeposited substrate to prepare a printing plate.

14. The process for preparing a printing plate according to claim 13, which has been made usable as a printing plate for wet printing by rendering the electrodeposit layer receptive to an ink and rendering the N-type photoconductor layer receptive to dampening water.

15. The process for preparing a printing plate according to claim 13, which has been made usable as a printing plate for dry printing by rendering the electrodeposit layer ink-repellent and rendering the N-type photoconductor layer receptive to an ink.

16. A process for preparing a printing plate, comprising the steps of: providing an N-type photoconductor layer having an optical memory property on the surface of a substrate having an electrical conductivity at least in its surface to form an N-type photoconductor substrate; exposing the whole surface or a necessary region of the N-type photoconductor layer to render exposed areas electrically conductive; heating the exposed areas by hot pattern drawing to erase the conductivity of the heated areas; immersing the N-type photoconductor substrate in an electrodeposition bath to electrodeposit a light-screening and/or electrical insulating first electrodeposit layer on the remaining conductive areas alone to form a first electrodeposit layer; washing the electrodeposited substrate; exposing the N-type photoconductor substrate to again render exposed areas electrically conductive; immersing the N-type photoconductor substrate in an electrodeposition bath to electrodeposit a second electrodeposition material on only areas with the first deposit layer having not been formed, thereby forming a second electrodeposit layer; and washing and drying the electrodeposited substrate to prepare a printing plate.

17. The process for preparing a printing plate according to claim 16, which has been made usable as a printing plate for dry printing by rendering one of the first electrodeposit layer and the second electrodeposit layer receptive to an ink with the other being rendered ink-repellent.

18. The process for preparing a printing plate according to claim 16, which has been made usable as a printing plate for wet printing by rendering one of the first electrodeposit layer and the second electrodeposit layer receptive to dampening water with the other being rendered receptive to an ink.

* * * * *